US009816257B2

(12) United States Patent
Blake et al.

(10) Patent No.: US 9,816,257 B2
(45) Date of Patent: Nov. 14, 2017

(54) SENSOR ASSEMBLY FOR FAUCET

(71) Applicant: Kohler Co., Kohler, WI (US)

(72) Inventors: Joseph Blake, Sheboygan, WI (US); Perry Erickson, Sheboygan, WI (US); John Esche, Kohler, WI (US); Steve Radder, Kiel, WI (US); Ross Ristow, Kiel, WI (US); Joseph Stauber, Sheboygan Falls, WI (US)

(73) Assignee: KOHLER CO., Kohler, WI (US)

( * ) Notice: Subject to any disclaimer, the term of this patent is extended or adjusted under 35 U.S.C. 154(b) by 118 days.

(21) Appl. No.: 14/453,522

(22) Filed: Aug. 6, 2014

(65) Prior Publication Data

US 2015/0040997 A1 Feb. 12, 2015

Related U.S. Application Data

(60) Provisional application No. 61/863,348, filed on Aug. 7, 2013.

(51) Int. Cl.

| | |
|---|---|
| ***F16K 37/00*** | (2006.01) |
| ***F17D 3/00*** | (2006.01) |
| ***E03C 1/05*** | (2006.01) |

(52) U.S. Cl.

CPC ..... *E03C 1/057* (2013.01); *Y10T 137/5987* (2015.04); *Y10T 137/8158* (2015.04)

(58) Field of Classification Search

CPC ..... E03C 1/057; G05D 23/1393; Y10T 137/8158

See application file for complete search history.

(56) References Cited

U.S. PATENT DOCUMENTS

| | | | | |
|---|---|---|---|---|
| 3,491,381 | A | 1/1970 | Cathcart | |
| 3,576,277 | A | 4/1971 | Blackmon | |
| 4,722,372 | A | 2/1988 | Hoffman et al. | |
| 4,767,922 | A | 8/1988 | Stauffer | |
| 4,886,207 | A | 12/1989 | Lee et al. | |
| 4,894,874 | A * | 1/1990 | Wilson | E03C 1/057 251/129.04 |
| 4,915,347 | A | 4/1990 | Iqbal et al. | |

(Continued)

FOREIGN PATENT DOCUMENTS

| | | | |
|---|---|---|---|
| CN | 1193367 | A | 9/1998 |
| CN | 1474919 | A | 2/2004 |

(Continued)

OTHER PUBLICATIONS

Brizo Pascal, Obedient-Intelligent, brochure, 2007, 3 pages.

(Continued)

*Primary Examiner* — Seth W Mackay-Smith
(74) *Attorney, Agent, or Firm* — Foley & Lardner LLP

(57) ABSTRACT

A sensor assembly for controlling a solenoid valve, the solenoid valve controlling the flow of water through a faucet, is described. The sensor assembly includes a head including a bottom portion configured to be supported by a wall and a top portion. The sensor assembly also includes a proximity sensor including a transmitter and receiver. The transmitter projects a beam into a detection zone. The sensor assembly also includes processing electronics configured to cause the solenoid valve to open in response to a receiver detecting a reflection from an object in the detection zone.

19 Claims, 15 Drawing Sheets

(56) References Cited

U.S. PATENT DOCUMENTS 4,962,790 A * 10/1990 Chou ..... E03C 1/057 137/599.08
5,025,516 A 6/1991 Wilson
5,060,323 A * 10/1991 Shaw ..... E03C 1/057 4/213
5,062,453 A * 11/1991 Saadi ..... E03D 3/08 137/624.11
5,074,520 A 12/1991 Lee et al.
5,135,028 A 8/1992 Rickenbach et al.
5,184,642 A * 2/1993 Powell ..... E03C 1/05 137/607
5,226,629 A 7/1993 Millman et al.
5,243,717 A 9/1993 Yasuo
5,287,570 A 2/1994 Peterson et al.
5,511,763 A 4/1996 Green
5,548,119 A * 8/1996 Nortier ..... G01S 7/4813 250/221
5,549,273 A 8/1996 Aharon
5,586,573 A * 12/1996 Nortier ..... E03C 1/0401 137/359
5,594,238 A * 1/1997 Endruschat ..... E03C 1/057 250/214 B
5,781,942 A * 7/1998 Allen ..... G08B 21/245 4/623
5,941,504 A * 8/1999 Toma ..... E03C 1/052 251/295
6,019,130 A * 2/2000 Rump ..... E03C 1/057 137/601.01
6,047,417 A 4/2000 Derakhshan
6,067,673 A 5/2000 Paese et al.
6,219,859 B1 4/2001 Derakhshan
6,234,021 B1 * 5/2001 Piety ..... G01H 1/00 73/592
6,250,601 B1 6/2001 Kolar et al.
6,305,663 B1 10/2001 Miller
6,448,758 B1 * 9/2002 Krahn ..... G01R 31/04 324/750.14
RE37,888 E 10/2002 Cretu-Petra
6,481,634 B1 * 11/2002 Zosimadis ..... E03C 1/041 236/12.12
6,481,983 B1 11/2002 Miller
6,568,655 B2 5/2003 Paese et al.
D487,798 S 3/2004 Bayer
6,874,535 B2 * 4/2005 Parsons ..... E03C 1/057 137/607
6,962,168 B2 11/2005 McDaniel et al.
7,028,725 B2 4/2006 Hooker
7,104,519 B2 9/2006 O'Maley et al.
7,624,757 B2 12/2009 Schmitt
7,690,395 B2 * 4/2010 Jonte ..... E03C 1/05 137/551
7,766,026 B2 8/2010 Boey
7,867,172 B1 1/2011 Baruti et al.
7,969,319 B2 * 6/2011 Kowalchuk ..... A01C 15/006 221/6
7,979,928 B2 * 7/2011 Allen, Jr. ..... E03C 1/057 4/623
8,006,712 B2 * 8/2011 Boey ..... E03C 1/057 137/15.17
8,028,355 B2 10/2011 Reeder et al.
8,104,113 B2 * 1/2012 Rodenbeck ..... E03C 1/057 251/129.03
8,162,236 B2 * 4/2012 Rodenbeck ..... E03C 1/057 239/390
8,308,651 B1 11/2012 Baruti
8,438,672 B2 5/2013 Reeder et al.
9,347,207 B2 * 5/2016 Chen ..... E03C 1/057
2007/0156260 A1 7/2007 Rodenbeck et al.
2007/0246550 A1 10/2007 Rodenbeck et al.
2008/0072965 A1 3/2008 Buechel et al.
2009/0000024 A1 * 1/2009 Louis ..... E03C 1/046 4/676
2009/0044873 A1 2/2009 Walter
2009/0119832 A1 5/2009 Conroy
2011/0139282 A1 6/2011 Loeck et al.
2011/0185493 A1 8/2011 Chen
2011/0186161 A1 8/2011 Chen
2011/0210276 A1 9/2011 Chen
2012/0227849 A1 9/2012 Rodenbeck et al.
2012/0260418 A1 * 10/2012 Rundberg ..... E03C 1/057 4/623
2012/0297534 A1 * 11/2012 Itazu ..... E03C 1/057 4/623
2013/0025045 A1 * 1/2013 Gagnon ..... A47K 1/04 4/654
2013/0174926 A1 7/2013 Derakhshan
2013/0248617 A1 * 9/2013 Sawaski ..... E03C 1/057 239/73
2014/0054478 A1 * 2/2014 Esche ..... F16K 31/05 251/129.03
2014/0259735 A1 * 9/2014 Muderlak ..... F26B 20/00 34/572
2014/0261749 A1 * 9/2014 Chen ..... E03C 1/057 137/78.1

FOREIGN PATENT DOCUMENTS

CN 201568624 U 9/2010
CN 202580227 U 12/2012
DE 16 58 243 9/1970
DE 197 12 222 10/1997
JP 2000-017700 1/2000
WO WO-2013/020545 2/2013

OTHER PUBLICATIONS

Moen Introduces MotionSense: A Uniquely Responsive, User-Friendly, Hands-Free Kitchen Faucet Experience, Apr. 2012, 3 pages.
MotionSense, http://www.moen.com/about-moen/smart-innovations/motionsense, Apr. 2012, 2 pages.
Search Report for International Application No. PCT/US2010/058730, mail date Jul. 3, 2011, 2 pages.

* cited by examiner

SENSOR ASSEMBLY FOR FAUCET

CROSS REFERENCE TO RELATED APPLICATION

This application claims the benefit and priority of U.S. Provisional Patent Application No. 61/863,348, filed on Aug. 7, 2013, which is incorporated herein by reference in its entirety.

BACKGROUND

The present disclosure relates generally to a sensor assembly for a faucet. The present disclosure more specifically relates to a sensor assembly for controlling the flow of water through the faucet.

Traditional faucets for a sink or other plumbing fixture may be operated by one or more touch or valve controls. For example, a faucet may include one or two mechanical valves (e.g., levers, knobs, etc.) that the user may operate to control the flow of water from the faucet. As another example, a faucet may be a touch-sensitive faucet such that the user may control the flow of water from the faucet by touching the faucet. As yet another example, a faucet may be a touchless faucet that includes a sensor for detecting a user input for controlling the flow of water from the faucet.

Traditional sensor assemblies for faucets are located near or on the faucet. For example, a sensor may be located such that a user may activate the flow of water by placing his or her hands directly under the faucet spout, in front of a sensor located on the faucet. Traditional sensor assemblies for faucets are integrated into new faucets, thus requiring a user to replace a faucet in order to upgrade from sensorless to sensor technology.

SUMMARY

One embodiment relates to a sensor assembly for controlling a solenoid valve. The solenoid valve controls the flow of water through a faucet. The faucet is spaced apart from the sensor assembly. The sensor assembly includes a head including a bottom portion configured to be supported by a wall and a top portion opposite the bottom portion. The sensor assembly further includes a proximity sensor. The proximity sensor includes a transmitter configured to project a beam into a detection zone on a side of the head opposite the wall, the beam extending substantially normal to and away from the wall. The proximity sensor further includes a receiver configured to detect a reflection of the beam off of an object in the detection zone. The sensor assembly further includes processing electronics configured to cause the solenoid valve to open in response to the receiver detecting a first reflection from the object in the detection zone. The sensor assembly may include a shank coupled to the head and passing through a first hole in the wall and a nut threadedly coupled to the shank such that tightening of the nut on the shank secures the head to the wall. The wall may include a rim extending from a basin, the rim defining the first hole and defining at least one faucet hole for mounting the faucet to the rim, the first hole spaced apart from the at least one faucet hole. The sensor assembly may include a translucent cover coupled to the top portion of the head, wherein the transmitter may include an infrared transmitter, and the beam may be projected through the translucent cover into the detection zone. The sensor assembly may include an indicia located on the translucent cover, the indicia indicating to a user where to pass an object in order to actuate the faucet. The head may include at least one light emitting diode (LED), the processing electronics controlling illumination of the LEDs to annunciate a state of the solenoid valve. The at least one light emitting diode may include a plurality of light emitting diodes arranged in a sequence, and wherein the processing electronics may cause the LEDs to illuminate sequentially when the solenoid valve is open. The head may include a touch sensor, wherein the processing electronics may cause the solenoid valve to open for a predetermined amount of time in response to the head being touched. The faucet may include a spout and at least one mechanical valve, each of the at least one mechanical valve having a handle operably coupled to the at least one mechanical valve, and wherein the solenoid valve is located downstream of the at least one mechanical valve and upstream of the spout. The faucet may include a spout and at least one mechanical valve, each of the at least one mechanical valve having a handle operably coupled to the at least one mechanical valve, and wherein the solenoid valve is located upstream of the at least one mechanical valve. The processing electronics may be configured to cause the solenoid valve to close in response to the receiver detecting a second reflection from the object in the detection zone. The sensor assembly may include a magnet disposed in the head and configured to magnetically couple the head to the wall and a battery electrically coupled to the processing electronics, wherein the processing electronics may be configured to control the solenoid valve via wireless communication.

Another embodiment relates to a system for controlling a flow of water through a faucet that provides water to a sink. The sink has a basin and a rim, the rim defining at least one faucet hole for mounting the faucet to the rim and defining an accessory hole spaced apart from the at least one faucet hole. The faucet has an outlet for discharging water into the basin and has at least one mechanical valve for controlling a temperature and a volume of the flow of water when the water is flowing. The system includes a solenoid valve fluidly interconnected between the at least one mechanical valve and the outlet. The system further includes a body located in the accessory hole. The system further includes a proximity sensor coupled to the body and configured to detect an object in a detection zone above the body. The solenoid valve closes in response to a first detection by the proximity sensor of an object in the detection zone. The body may include at least one of a vacuum breaker and a soap dispenser. The proximity sensor may include an infrared transmitter, and the proximity sensor may be configured to detect an object within approximately 30 centimeters of the transmitter. The system may include an indicia proximate the proximity sensor cueing a user where to where to pass an object in order to actuate the faucet, the solenoid valve may close in response to a second detection by the proximity sensor of an object in the detection zone, and the indicia may be illuminated when the solenoid valve is closed.

Another embodiment relates to a system for controlling a flow of water through a faucet that provides water to a sink. The sink has a basin and a rim, the rim defining at least one faucet hole for mounting the faucet to the rim and defining an accessory hole spaced apart from the at least one faucet hole. The faucet has an outlet for discharging water into the basin and has at least one mechanical valve for controlling a temperature and a volume of the flow of water when the water is flowing. The system includes at least one solenoid valve fluidly interconnected upstream of the at least one mechanical. The system further includes a body located in the accessory hole. The system further includes a proximity sensor coupled to the body and configured to detect an object in a detection zone above the body. The solenoid valve closes in response to a first detection by the proximity sensor of an object in the detection zone. The body may include at least one of a vacuum breaker and a soap dispenser. The proximity sensor may include an infrared transmitter, and the proximity sensor may be configured to detect an object within approximately 30 centimeters of the transmitter. The system may include an indicia proximate the proximity sensor cueing a user where to where to pass an object in order to actuate the faucet, the solenoid valve may close in response to a second detection by the proximity sensor of an object in the detection zone, and the indicia may be illuminated when the solenoid valve is closed.

Another embodiment relates to a kit for retrofitting an existing faucet system from manual to touchless operation, the existing faucet system including a faucet having an outlet for discharging water from the faucet into a basin and having a mechanical valve fluidly coupled to the outlet for controlling a flow of water through the faucet. The kit includes a solenoid valve assembly having a solenoid valve, an inlet, and an outlet. The kit also includes a proximity sensor assembly configured to detect an object in a detection zone. The kit also includes processing electronics configured to toggle the solenoid valve between an open state and a closed state in response to the proximity sensor assembly detecting the object in the detection zone. The kit further includes instructions for retrofitting the existing faucet system. The instructions include fluidly decoupling the mechanical valve from the outlet of the faucet. The instructions further include fluidly coupling the mechanical valve to the inlet of the solenoid valve. The instructions further include fluidly coupling the outlet of the faucet to the outlet of the solenoid valve. The instructions further include placing the object in the detection zone to cause the solenoid valve to toggle between the open state and the closed state. The basin may have a rim defining at least one faucet hole for mounting the faucet and defining an accessory hole spaced apart from the at least one faucet hole, wherein the proximity sensor may include a body, and wherein the instructions may include inserting the body into the accessory hole. The basin may be coupled to a deck, the deck defining at least one faucet hole for mounting the faucet and defining an accessory hole spaced apart from the at least one faucet hole, wherein the proximity sensor includes a body, and wherein the instructions may include inserting the body into the accessory hole. The proximity sensor assembly may include a wireless communication transmitter, and the solenoid valve assembly may include a wireless communication receiver, and wherein the instructions may include establishing wireless communication between the proximity sensor assembly and the solenoid valve assembly. The proximity sensor assembly may include a magnet, and wherein the instructions may include magnetically coupling the proximity sensor assembly to a metallic surface.

Another embodiment relates to a kit for retrofitting an existing faucet system from manual to touchless operation, the existing faucet system including a faucet having an outlet for discharging water from the faucet into a basin and having a mechanical valve fluidly coupled to the outlet for controlling a flow of water through the faucet, the mechanical valve configured to receive water from a water supply. The kit includes a solenoid valve assembly having at least one solenoid valve, an inlet, and an outlet. The kit also includes a proximity sensor assembly configured to detect an object in a detection zone. The kit also includes processing electronics configured to toggle the at least one solenoid valve between an open state and a closed state in response to the proximity sensor assembly detecting the object in the detection zone. The kit also includes instructions for retrofitting the existing faucet system. The instructions include fluidly decoupling the outlet of the faucet from the water supply, fluidly coupling the solenoid valve assembly to the mechanical valve, and placing the object in the detection zone to cause the at least one solenoid valve to toggle between the open state and the closed state. The kit may include a body configured to support the proximity sensor assembly. The basin may have a rim coupled to a deck, at least one of the basin and the deck may define at least one faucet hole for mounting the faucet, the at least one of the basin and the deck may define an accessory hole spaced apart from the at least one faucet hole, and the instructions may include inserting the body into the accessory hole. The proximity sensor assembly may include a wireless communication transmitter, and the solenoid valve assembly may include a wireless communication receiver, and wherein the instructions may include establishing wireless communication between the proximity sensor assembly and the solenoid valve assembly. Fluidly decoupling the outlet of the faucet from the water supply may include fluidly decoupling the mechanical valve from the water supply. Fluidly coupling the solenoid valve assembly to the mechanical valve may include fluidly coupling the outlet of the solenoid valve assembly to an inlet of the mechanical valve. The instructions may include fluidly coupling the water supply to the inlet of the solenoid valve assembly and operably coupling at least one of the proximity sensor assembly and the processing electronics to the solenoid valve assembly. The inlet of the mechanical valve may include a first hot inlet and a first cold inlet, the outlet of the solenoid valve assembly may include a hot outlet and a cold outlet, the inlet of the solenoid valve assembly may include a second hot inlet and a second cold inlet, the water supply may include a hot supply and a cold supply. Fluidly coupling the inlet of the mechanical valve to the outlet of the solenoid valve assembly may include fluidly coupling the first hot inlet to the hot outlet and fluidly coupling the first cold inlet to the cold outlet, and fluidly coupling the water supply to the inlet of the solenoid valve assembly may include fluidly coupling the hot supply to the second hot inlet and fluidly coupling the cold supply to the second cold inlet.

The foregoing is a summary and thus, by necessity, contains simplifications, generalizations, and omissions of detail. Consequently, those skilled in the art will appreciate that the summary is illustrative only and is not intended to be in any way limiting. Other aspects, inventive features, and advantages of the devices and/or processes described herein will become apparent in the detailed description set forth herein and taken in conjunction with the accompanying drawings.

DETAILED DESCRIPTION

Figure 1:
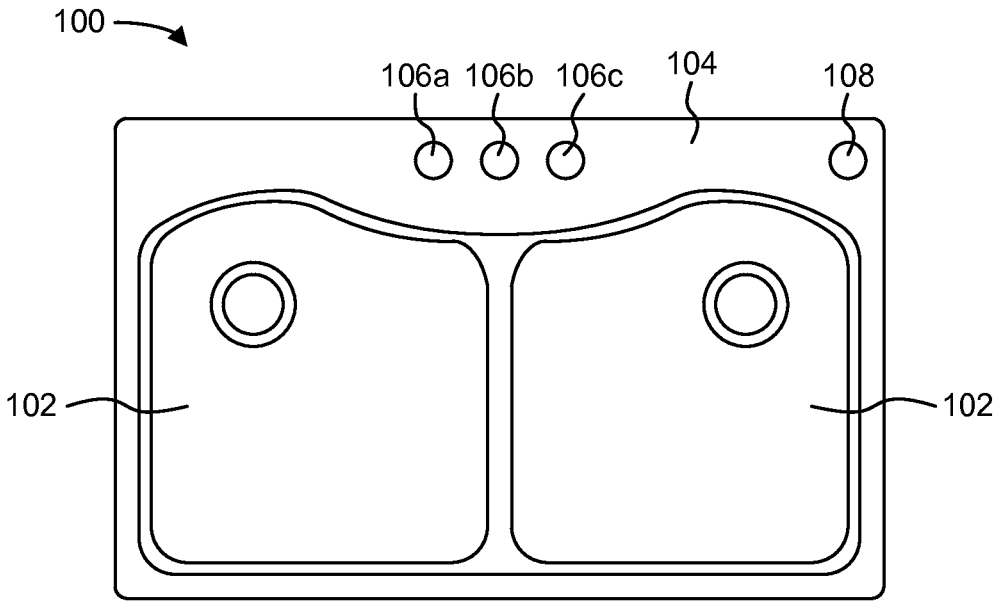
FIG. 1 is a top plan view of a sink, according to an exemplary embodiment.

Referring generally to the figures, systems and methods for controlling a flow of water through a faucet using a sensor assembly is shown and described. The systems and methods described herein allow for a sensor to be installed remotely from the faucet. A user may then control a flow of water through the faucet by interacting with the sensor. For example, the sensor may be located in an upper right or upper left portion of a sink (as shown in FIG. 1), away from the faucet, and the user may wave his or her hand over the sensor to cause the output of water through the faucet. The sensor assembly may include a proximity sensor (e.g., touch sensor, capacitive sensor, ultrasonic sensor, infrared sensor, etc.).

One embodiment of the present disclosure is a faucet system including the sensor and a solenoid valve. The solenoid valve is fluidly interconnected between the one or more mechanical valves of the faucet and the faucet outlet. Upon detection of an input from a user by the sensor, the sensor may transmit a signal to the solenoid valve that causes the solenoid valve or open or close, allowing or disallowing the flow of water through the faucet. The sensor may be configured to communicate with the solenoid valve via a wireless (or wired) connection.

One embodiment of the present disclosure allows for retrofitting of an existing faucet system with the faucet system described herein. After decoupling the mechanical valve of the existing faucet system from the outlet of the faucet, the mechanical valve is coupled to the inlet of a solenoid valve and the faucet outlet is coupled to the outlet of the solenoid valve.

The proximity sensor may be part of a sensor assembly placed in an appropriate location remotely from the faucet. The sensor assembly may include a transmitter and receiver for projecting a beam into a detection zone of the sensor and detecting a reflection from a user (or other object) of the beam. The sensor assembly may include processing electronics configured to operate the solenoid valve based on the detection. The sensor assembly may further include a head configured to be supported by a sink, other plumbing fixture, wall, or other object. For example, the sensor head may be configured to fit in an accessory hole of a sink. A translucent cover may be coupled to the sensor head, and the beam is projected through the cover into the detection zone. The sensor assembly may further include indicia located on the cover or elsewhere on the sensor assembly. The indicia may, for example, cue a user to turn on or off the flow of water with a particular action, display a current status relating to faucet system operation, or the like. The indicia may be one or more lights (e.g., light emitting diodes (LEDs), incandescent bulbs, fluorescent bulbs, etc.).

Before discussing further details of the sensor assembly and faucet operation and/or the components thereof, it should be noted that references to "front," "back," "rear," "upward," "downward," "inner," "outer," "right," and "left" in this description are merely used to identify the various elements as they are oriented in the figures. These terms are not meant to limit the element which they describe, as the various elements may be oriented differently in various implementations.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Figure 2:
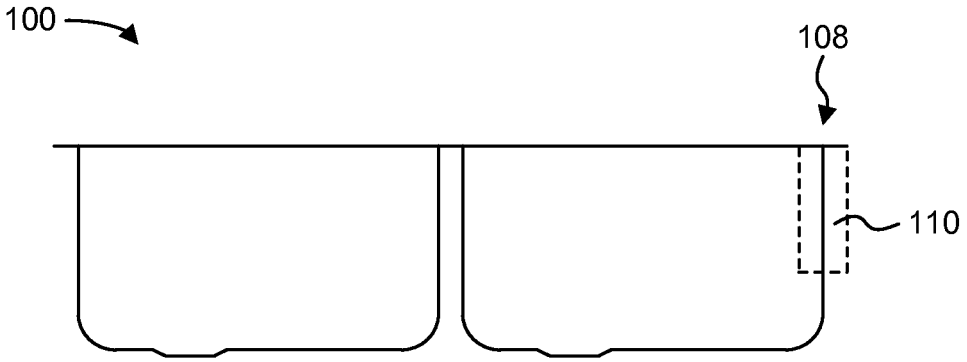
FIG. 2 is a front view of the sink of FIG. 1, according to an exemplary embodiment.

Referring to FIGS. 1-2, a top plan view and front view of a sink 100 is illustrated. Sink 100 may be a sink, such as a kitchen sink, for which the faucet system of the present disclosure may be implemented. Sink 100 may generally include a basin 102 and a rim or deck 104 extending from or coupled to basin 102. For example, a rear sink deck is shown positioned behind basin 102. A series of holes 106*a-c* are typically disposed within the sink deck. The diameter of holes 106*a-c* is typically of a standard size used to mount a variety of sink fixtures and sink accessories (e.g., 1⅜ inches or 3.5 centimeters). Sink 100 may be mounted within a countertop, and cabinet doors may be installed in the front of basin 102 in order to provide access to the plumbing underneath sink 100. Sink 100 is shown to be a self-rimming sink, mounted on the countertop, but in other embodiments, the sink may be an undermount sink, apron-front sink, vessel sink, etc. Holes 106*a-c*, being positioned behind basin 102, may be accessed through the cabinet doors.

Holes 106*a-c* are shown centrally and horizontally aligned along sink deck 104. Center hole 106*b* may typically be used to mount a faucet spout for discharging water from the faucet into basin 102. Holes 106*a, c* may be used to mount one or more faucet valves. The one or more faucet valves may be operably coupled to one or more mechanical valves that control the output (e.g., the temperature and rate of flow) of water. In one embodiment two faucet valves may be mounted to holes 106*a, c*. One faucet valve may be used to control the output of hot water, and the other faucet valve may be used to control the output of cold water. In another embodiment, the faucet may be mounted over hole 106*b*, and the water lines may pass through holes 106*a, c*. In yet another embodiment, a single faucet valve (or knob or other lever) coupled to the faucet spout mounted over center hole 106*b* may be used to control the output of water (i.e., the flow and the temperature of the water), and nothing may be mounted to holes 106*a, c*. In yet other embodiments other configurations are possible.

In an embodiment of the present disclosure, a solenoid assembly, including a solenoid valve, may be coupled in between the faucet spout and the one or more mechanical valves. The solenoid valve controls the flow of water through the faucet. The solenoid valve may be controlled by a sensor located apart from the solenoid assembly as described in the present disclosure.

In addition to the central row of holes 106*a-c*, the sink deck may also include a hole 108 positioned towards a far corner (e.g. a rear right side as shown in FIGS. 1-2 and in relation to a user standing in a position in front of the sink using the sink) of sink 100. Hole 108 is spaced apart from faucet holes 106*a-c*. Hole 108 may be an accessory hole (sometimes referred to in the art as a "fourth hole") for mounting a sink accessory 110, such as a soap dispenser, vacuum breaker, etc. Hole 108 may be of a conventional size for a faucet hole of the sink, or may be any other suitable size.

Hole 108 may define a hole in deck 104 of sink 100 in which a sensor assembly of the present disclosure may be installed. For example, the sensor assembly may generally include a head or top portion configured to be secured on rim 104, a shank coupled to the head configured to be inserted into hole 108, and a nut that may be coupled to the shank in order to secure the head to rim 104. In another embodiment, the sensor assembly may be coupled to sink accessory 110 (e.g., soap dispenser, vacuum breaker, etc.) when installed, if sink accessory 110 is located in hole 108.

The sensor and sensor assembly of the present disclosure is described for use with a faucet such as a faucet for a kitchen sink (as shown in FIGS. 1-2). It should be understood that while the present disclosure describes the use of the sensor and sensor assembly for a kitchen sink as shown in FIGS. 1-2, the sensor and sensor assembly may be installed in other locations in which the sensor may control a faucet output. For example, the sensor and sensor assembly may be installed for a bathtub, bathroom sink, any other type of sink, or any other type of plumbing fixture in which water is output through a faucet. The sensor and sensor assembly may be installed in any location on or around the plumbing fixture (e.g., on a rim of the plumbing fixture, on a wall next to the plumbing fixture, etc.). In one embodiment, the sensor may be mounted to a forward portion of the sink to provide convenient access, for example, to users with disabilities. The wall as described in the present disclosure may be, for example, a vertical wall (e.g., backsplash), a countertop 142 (see, e.g., FIG. 9), a sink, a bathtub, a deck, etc, or any combination thereof. In some embodiments, the sink may be an undermount sink, and holes 106*a-c*, 108 may be located in a countertop supporting the sink.

Referring generally to FIGS. 3-9, a sensor assembly 200 of the present disclosure is shown, according to an exemplary embodiment. The sensor assembly includes circuitry configured to control a solenoid valve of a faucet assembly, thereby controlling the flow of water through the faucet. Sensor assembly 200 is generally shown to include a head 202 housing a proximity sensor 230 and processing electronics configured to operate the solenoid valve based on the proximity sensor reading. Sensor assembly 200 further includes a shank 208 coupled to head 202. Shank 208 may be generally configured to pass through a hole in the rim or deck of a plumbing fixture, or to otherwise allow for coupling to another object. Sensor assembly 200 further includes a nut 210 that may be threadedly coupled to shank 208 for securing sensor assembly 200 in a hole or other object.

Figure 3:
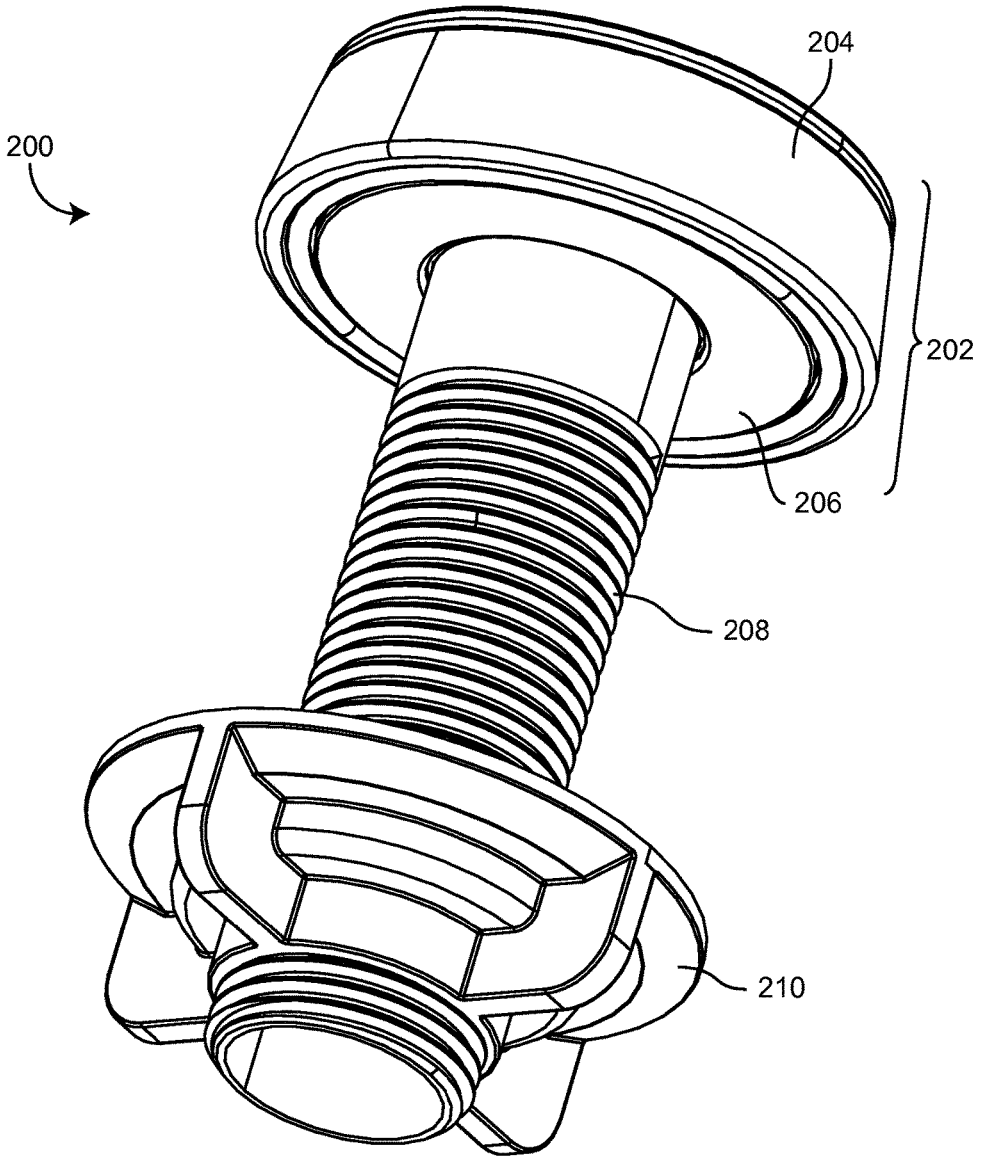
FIG. 3 is a bottom perspective view of a sensor assembly of the present disclosure, according to an exemplary embodiment.

Referring more specifically to FIG. 3, a bottom perspective view of sensor assembly 200 is shown. Sensor assembly 200 generally includes head 202, shank 208, and nut 210 as described above. Head 202 may generally include a top portion 204 and bottom portion 206. Bottom portion 206 may be supported by a rim or deck of the sink. For example, when sensor assembly 200 is installed in the kitchen sink of FIGS. 1-2, bottom portion 206 may rest on the rim or deck of the sink, with head 202 (and the detection zone of the proximity sensor in sensor assembly 200) aligned upwards. Top portion 204 may house the processing electronics of sensor assembly 200.

As another example, bottom portion 206 may include a magnet or other coupling feature. In such an embodiment, sensor assembly 200 may not include shank 208 or nut 210. Sensor assembly 200 may then be magnetically coupled to a metallic surface on or around the sink. For example, the metallic surface may be the sink deck, any portion of a cast iron sink, a magnetically responsive backsplash or backsplash tile, etc.

Shank 208 and nut 210 are shown as threaded. In an exemplary embodiment, sensor assembly may be secured by tightening nut 210 onto shank 208, locking sensor assembly 200 (and more particularly head 202) in place. In other embodiments, shank 208 and nut 210 may not be threaded, and other methods of securing sensor assembly 200 to the sink may be used (e.g., using a bayonet connector, a snap-fit connector, a Christmas tree-type connector, etc.). Shank 208 may either be a hollow shank or solid shank, and may house some or all of the processing electronics or wires running from the processing electronics housed within head 202.

Figure 4:
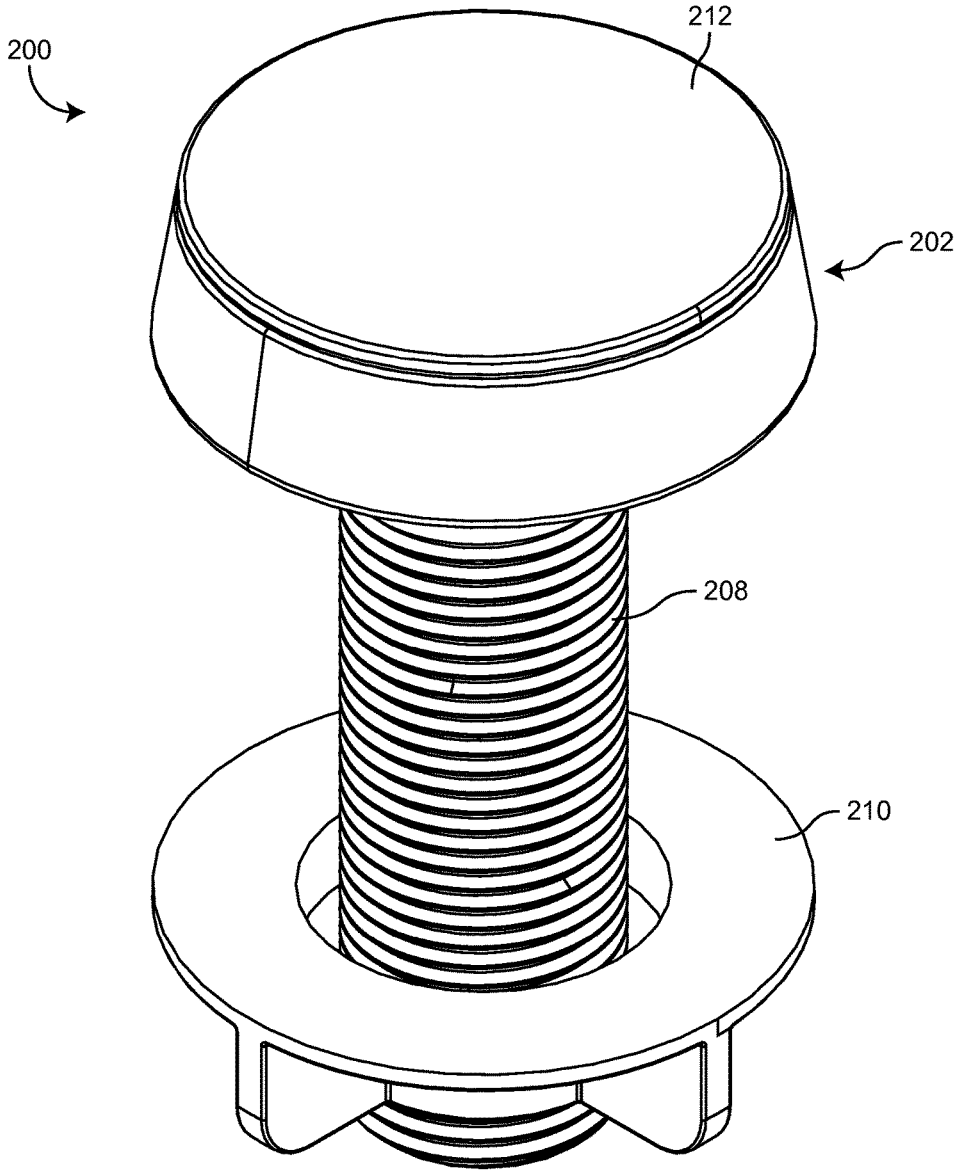
FIG. 4 is a top perspective view of the sensor assembly of FIG. 3, according to an exemplary embodiment.
Figure 5:
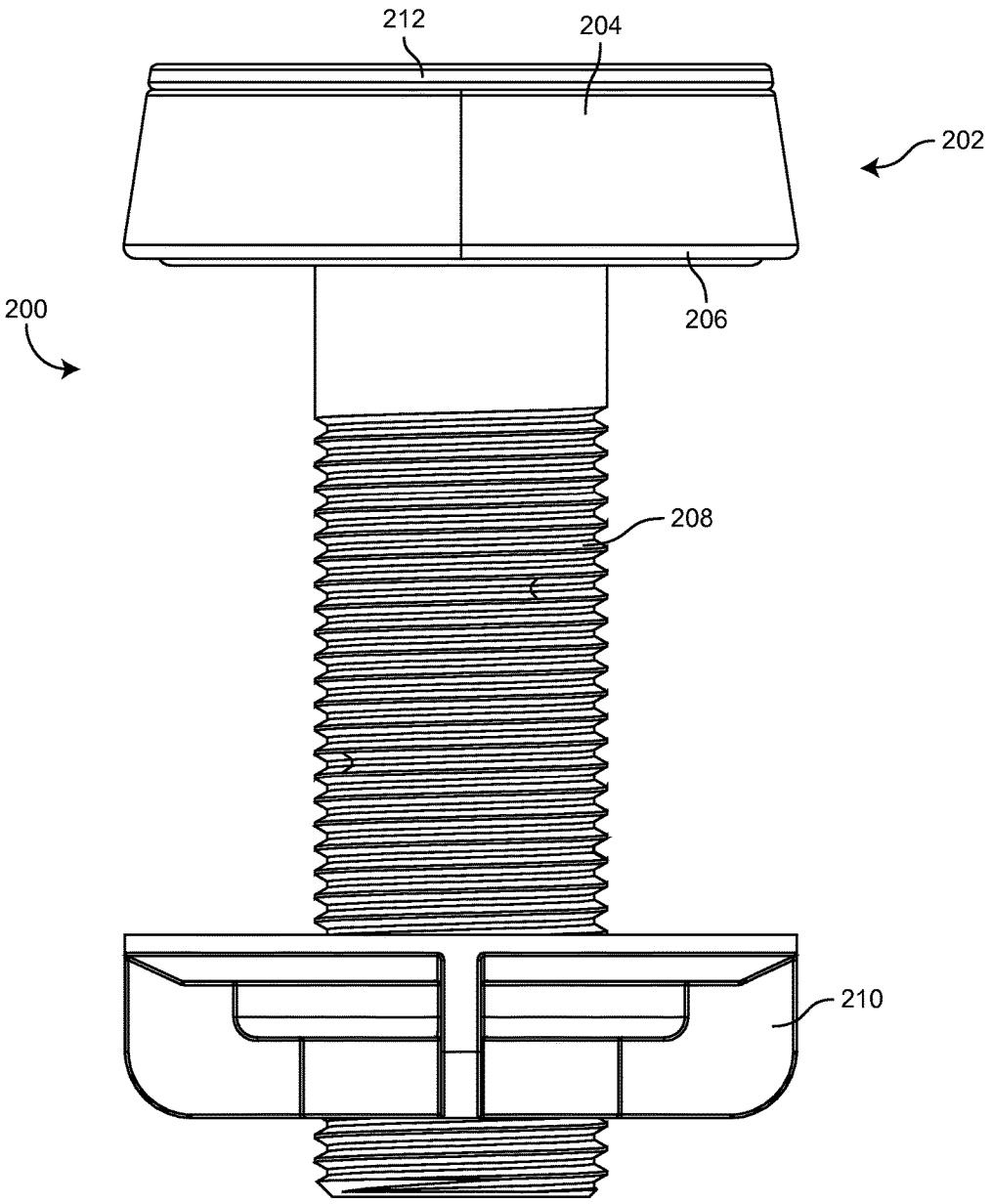
FIG. 5 is a front elevation view of the sensor assembly of FIG. 3, according to an exemplary embodiment.

Referring to FIGS. 4-5, a perspective view and front view of sensor assembly 200 is shown, according to an exemplary embodiment. Sensor assembly 200 includes a cover 212 (e.g., lens, outer lens, etc.) coupled to top portion 204 of head 202. Cover 212 may serve as a cover for the processing electronics of sensor assembly 200 housed within head 202. Cover 212 may further be a translucent (including transparent) cover. A transmitter of sensor assembly 200 may be configured to project a beam through the translucent cover, which may be used for object detection (e.g., to detect a user interacting with sensor assembly 200 to turn on or off the faucet). The translucent cover may further allow for one or more light emitting diodes (LEDs) or other lights to be visible through cover 212. The lights may indicate a current status of the faucet system to the user.

Cover 212 may further serve as a display of sensor assembly 200. For example, cover 212 may include indicia such as one or more symbols, text, or other displays that may illuminate or otherwise become visible before, during, or after operation of the faucet. The indicia may be printed, etched, or formed onto cover 212. The indicia may serve various purposes for allowing the user to interact with sensor assembly 200.

The indicia may indicate to a user where to pass an object in order to actuate the faucet. For example, the indicia may indicate to the user where to wave his or her hand in order to actuate or de-actuate the faucet. As another example, the indicia may indicate to the user the type of motion to use to actuate the faucet, how to touch cover 212 in order to actuate the faucet (e.g., by tapping cover 212 one or more times, by pressing on cover 212 for a predetermined period of time, etc.) etc. As another example, the indicia may indicate a current status relating to faucet operation (e.g., the indicia may indicate that the state of the solenoid valve is open or closed). The indicia may include, for example, an image of a waving hand or the words "wave here" to indicate to the user to wave, and where to wave, his or her hand to operate the faucet.

In one embodiment, the faucet may be operated via the user touching cover 212. Sensor assembly 200 may include a touch sensor integrated with cover 212 which is configured to detect such user interaction. In other words, cover 212 is touch sensitive. The touch sensor may detect the type of user interaction with cover 212 (e.g., a tap, a press, touchscreen gestures, etc.). For example, a user may tap cover 212 to actuate the faucet, tap cover 212 a second time to deactivate the faucet, tap or press down on cover 212 to indicate how much water to flow out from the faucet, etc. In other words, based on how the user touches cover 212, the faucet may be turned on, off, or turned on for a pre-determined amount of time. In other embodiments, other parts of sensor assembly 200, such as head 202, may be touch sensitive.

Figure 6:
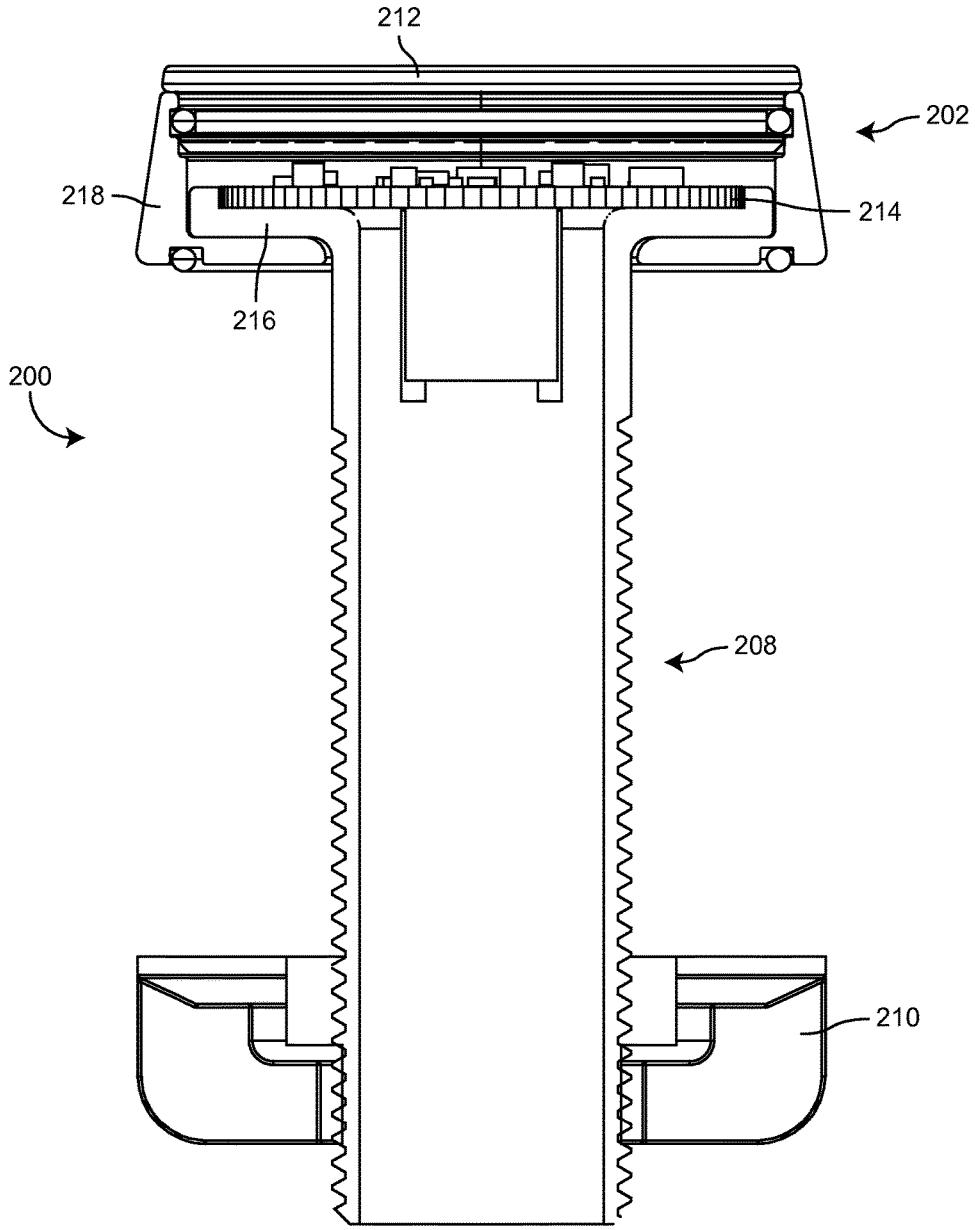
FIG. 6 is a front elevation section view of the sensor assembly of FIG. 3, according to an exemplary embodiment.
Figure 7:
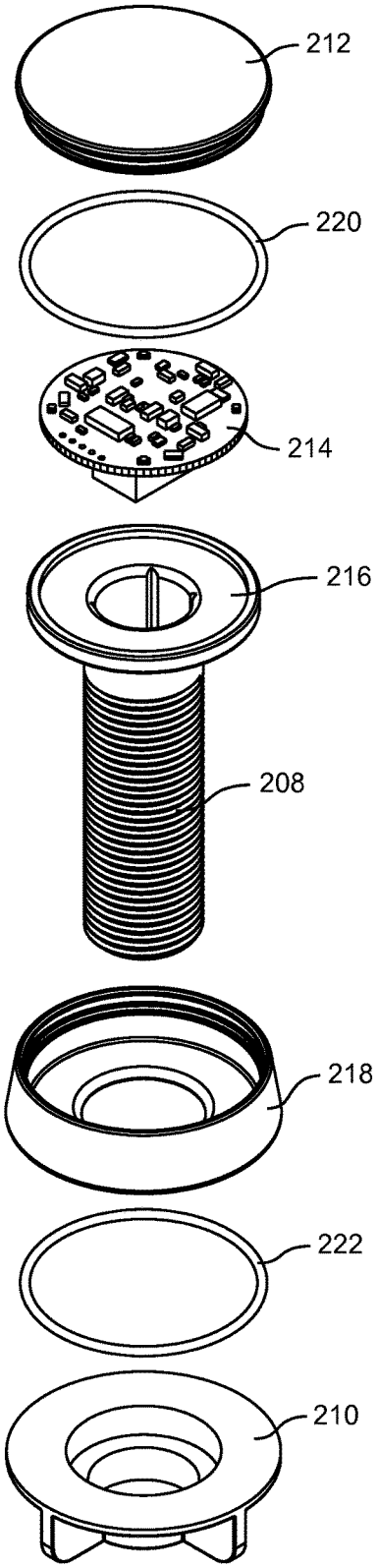
FIG. 7 is an exploded view of the sensor assembly of FIG. 3, according to an exemplary embodiment.

Referring to FIGS. 6-7, a front section view and exploded view of sensor assembly 200 are shown, according to an exemplary embodiment. Sensor assembly 200 is shown to generally include a base trim 216 and a base 218 (e.g., escutcheon) surrounding circuitry 214. Base trim 216 is shown to be a flange extending from shank 208 and rests over bottom portion 206. Sensor assembly 200 further includes an o-ring 220 trapped between an annular groove in cover 212 and a corresponding annular groove in base 218, to secure cover 212 to base 218. Sensor assembly 200 further includes an o-ring 222 located in an annular groove in a bottom surface of bottom portion 206 to seal base 218 to the wall or deck, for example to stray fluid from reaching hole 108.

Figure 10:
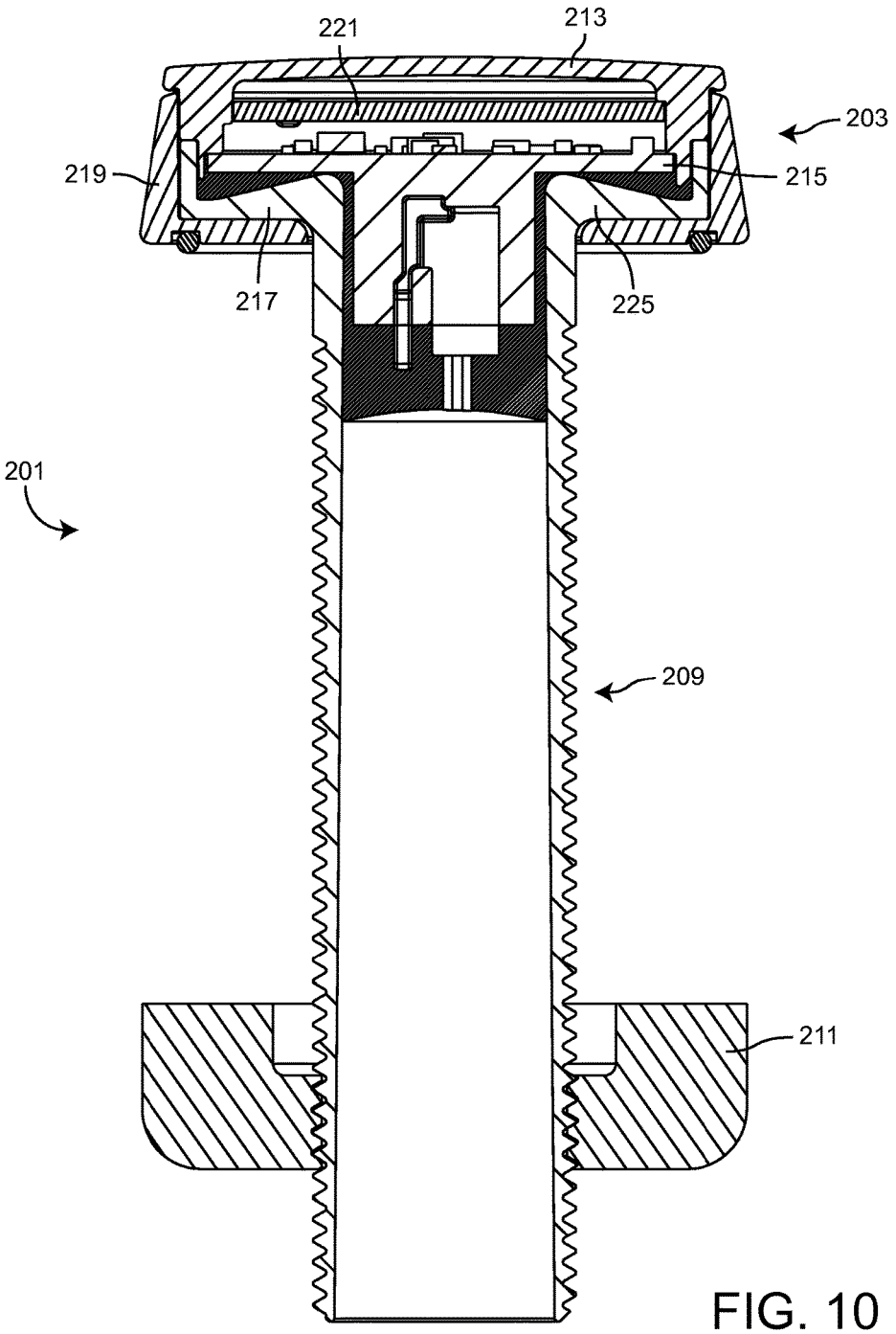
FIG. 10 is a right elevation section view of a sensor assembly, according to another exemplary embodiment.
Figure 11:
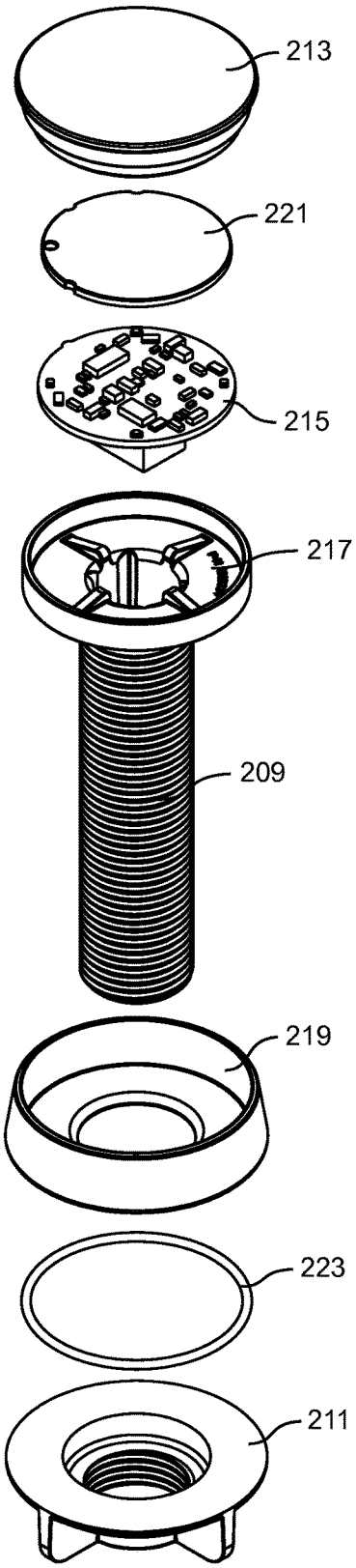
FIG. 11 is an exploded view of the sensor assembly of FIG. 10, according to an exemplary embodiment.

Referring briefly to FIGS. 10-11, a front section view and exploded view of another exemplary embodiment of a sensor assembly 201 is shown. Sensor assembly 201 is shown to generally include a base trim 217 and a base 219 (e.g., escutcheon) surrounding circuitry 215. Base trim 217 is shown to be a flange extending from shank 209 and rests over a bottom portion of the base 219. Sensor assembly 201 further includes a lens 221 (e.g., inner lens, etc.) positioned between the circuitry 215 and the cover 213. According to one embodiment, the lens 221 is coupled to the cover 213 by snap fit, press fit, or friction fit. The circuitry 215 may be supported on a plurality of protrusions 225 extending upward from the base trim 217. The circuitry 215 may be potted in the base trim 217 using, for example, a dielectric gel. According to another embodiment, the cover 213, the circuitry 215, the base trim 217, and the lens 221 may be potted with, for example, dielectric gel to form a subassembly. Sensor assembly 201 further includes an o-ring 223 located in an annular groove in a bottom surface of the bottom portion of the base 219 to seal base 219 to the wall or deck, for example to stray fluid from reaching hole 108. In an exemplary embodiment, the sensor assembly 201 may be secured to the wall by threadably tightening nut 211 onto shank 209, locking sensor assembly 201 (and more particularly head 203) in place. For the sake of clarity, sensor assembly 200 may be used generically in the rest of the application to refer to one or either of the embodiments shown as sensor assembly 200 or sensor assembly 201.

Figure 8:
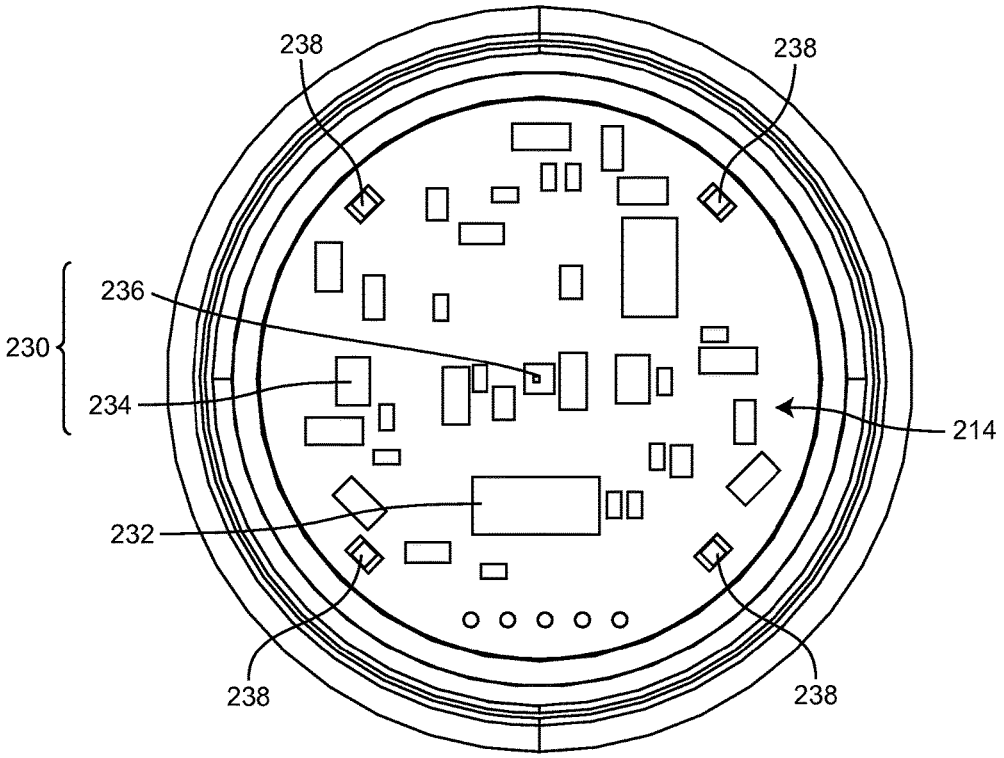
FIG. 8 is a top plan view of the sensor assembly of FIG. 3, according to an exemplary embodiment.

Referring also to FIG. 8, circuitry 214 of sensor assembly 200 is shown, according to an exemplary embodiment. Circuitry 214 may include the proximity sensor 230 and associated processing electronics 232 for detecting an object in a detection zone as discussed below (all labeled components of circuitry 214 are by way of example only; any configuration of components on circuitry 214 is possible). The proximity sensor 230 of circuitry 214 may include a transmitter 234 for transmitting a beam. The beam may be any type of beam (e.g., ultrasonic, infrared light, visible light, etc.) transmitted in any pattern type to create any type of detection zone. The proximity sensor 230 of circuitry 214 may include a receiver 236 for receiving a detection of an object in the detection zone created by the beam (e.g., detecting a reflection of the beam off of an object in the detection zone). According to the embodiment shown, the transmitter 234 and the receiver 236 are spaced apart; however, in other embodiments, the transmitter 234 and receiver 236 may the close together in a unified proximity sensor 230.

Circuitry 214 may further include any LEDs 238 or other displays configured to be displayed through a translucent cover 212. Circuitry 214 may be configured to control illumination of LEDs 238 based on the faucet status and user interaction. For example, circuitry 214 may illuminate one set of LEDs when the faucet is not running. As another example, the LEDs may be arranged in a sequence (e.g., a ring, circle, square, etc., of LEDs around the periphery of the circuitry 214 (as shown in FIG. 8), a linear sequence (for example, if the five circles at the bottom of the circuitry shown in FIG. 8 were LEDs 238), in a grid of x by y LEDs, etc.), and circuitry 214 may cause LEDs 238 to illuminate sequentially while the faucet is running. The LEDs may be illuminated in a pattern or color to convey other information to the user (e.g., a fault code, a temperature of the water, etc.) The components of circuitry 214 are described in greater detail below, with respect to FIG. 11.

Figure 9:
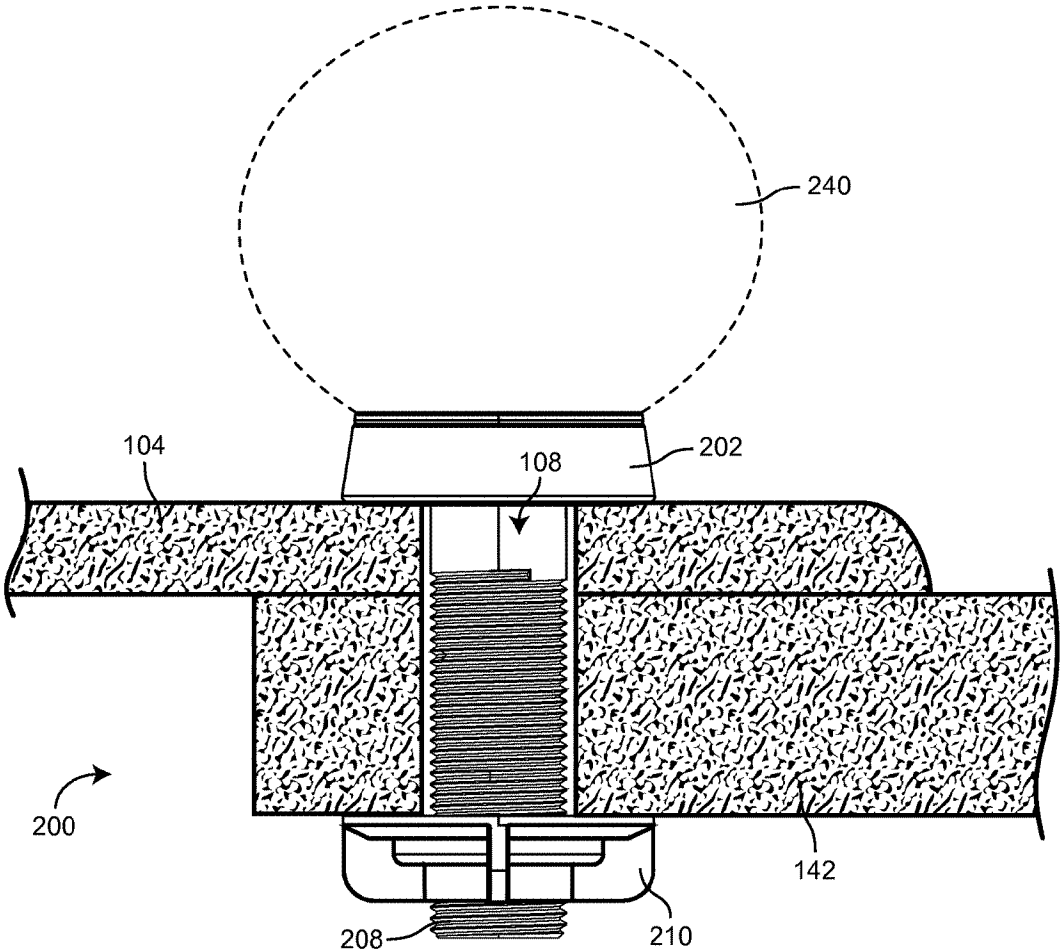
FIG. 9 is a perspective view of the sensor assembly of FIG. 3 supported by a wall, according to an exemplary embodiment.

Referring to FIG. 9, a right elevation view of sensor assembly 200 supported by a wall is shown, according to an exemplary embodiment. The wall is shown as a sink deck 104 supported by a countertop 142, and sensor assembly 200 is shown inserted in accessory hole 108. According to another embodiment, the sink may be an undermount sink, and the sink deck 104 may be coupled to an underside of the countertop 142. According to another embodiment, the accessory hole 108 may be further to the right (relative to FIG. 9) such that the accessory hole 108 passes through the countertop 142 but not the sink deck 104.

Sensor assembly 200 may project a detection zone 240. A transmitter 234 of sensor assembly 200 may be configured to project a beam to create detection zone 240. The beam may extend substantially normal to and away from sink deck 104, creating a detection zone 240 above sensor assembly 200. In one embodiment, the detection zone may extend eight to twelve inches (or approximately 20 to 30 centimeters) above sensor assembly 200. In other embodiments, the detection zone may extend closer to or further away from sensor assembly, and may extend in additional directions than normal to the wall or sink deck 104. When a user moves an object (e.g., a dish) or his or her hand through detection zone 240, sensor assembly 200 may interpret the motion and provide instructions to the solenoid valve. For example, reflection of the beams off of the object may be detected by receiver 236, and the circuitry 214 sends a signal to the solenoid valve 302 (shown schematically in FIG. 10). Detection zone 240 is shown as spherical; however, it should be understood that detection zone 240 may extend in any direction and may have any shape (e.g., conical, cylindrical, etc.).

Figure 12:
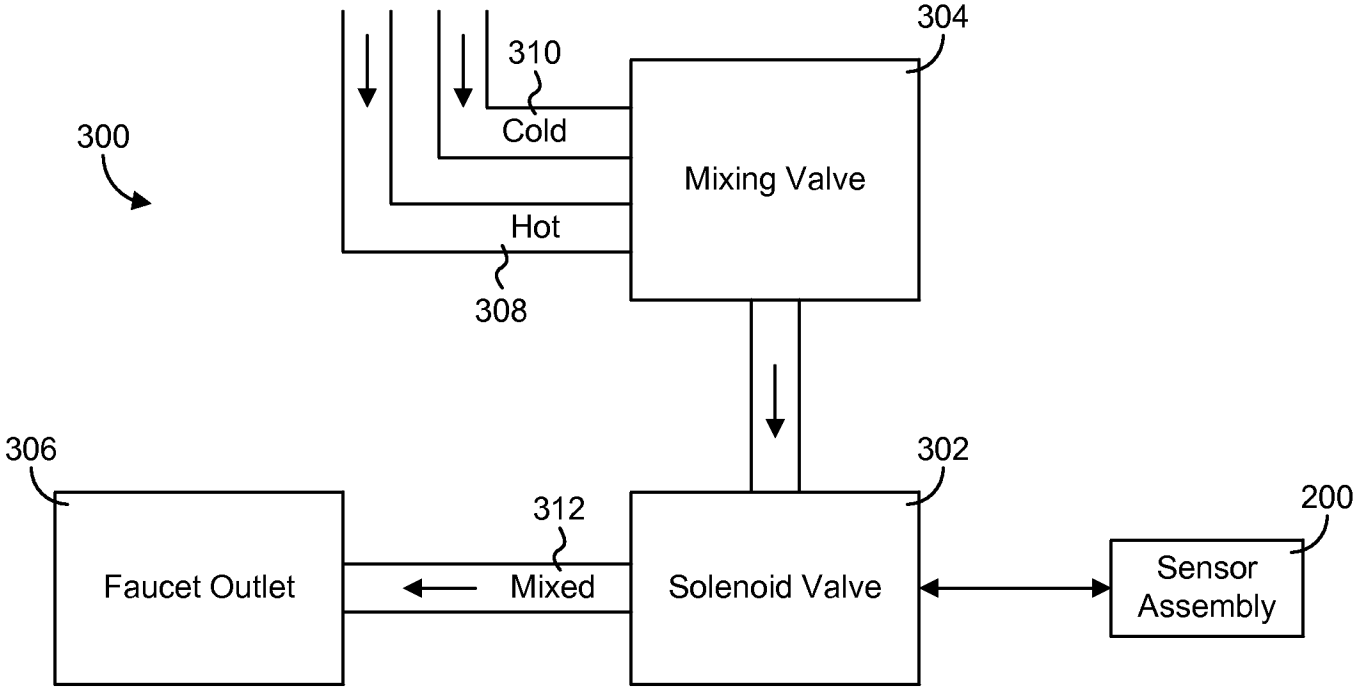
FIG. 12 is a block diagram of a faucet assembly, including a sensor and solenoid valve, according to an exemplary embodiment.

Referring to FIG. 12, a block diagram of a faucet assembly 300 is shown, according to an exemplary embodiment. Traditional faucet assemblies may generally include a mechanical valve receiving hot and cold water. The mechanical valve may be controlled by one or more faucet valves manually operated by a user. The mechanical valve may be a mixing valve that mixes the hot and cold water based on the operation of the faucet valves. The mixed water is then provided to the faucet outlet (e.g., the spout) for discharge. Alternatively, some faucet assemblies may include a mixing valve at the faucet outlet, which is configured to receive both hot and cold water separately from two mechanical valves.

A faucet assembly 300 of the present disclosure is illustrated in FIG. 12, according to an exemplary embodiment. A solenoid valve 302 is shown coupled in between mixing valve 304 and faucet outlet 306. Hot water 308 and cold water 310 may run through mixing valve 304, and the mixed temperature water 312 may run through solenoid valve 302 to faucet outlet 306. In another embodiment, hot water 308 and cold water 310 may run through two different valves instead of a single mixing valve 304, and may both run through solenoid valve 302 to faucet outlet 306, where the water is then mixed.

Figure 13:
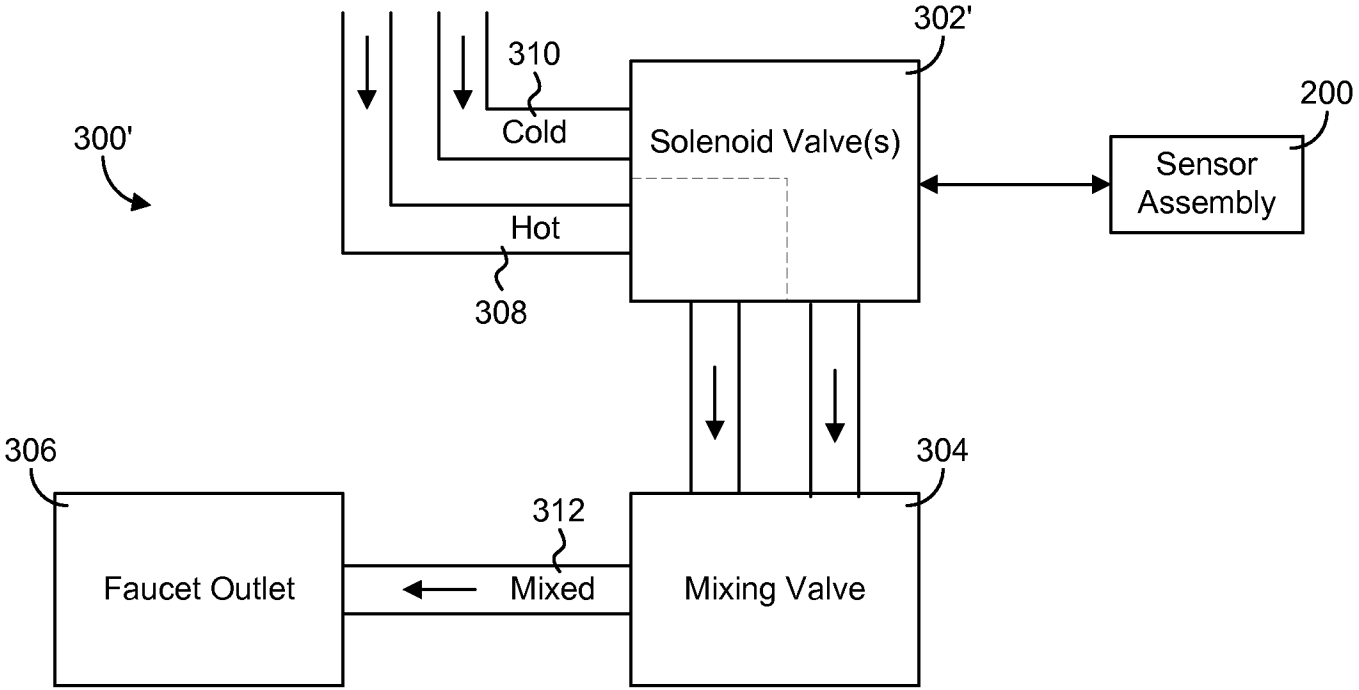
FIG. 13 is a block diagram of a faucet assembly, including a sensor and solenoid valve, according to another exemplary embodiment.

Referring to FIG. 13, a block diagram of a faucet assembly 300' is shown, according to an exemplary embodiment. A solenoid valve 302' is shown to be upstream of the mixing valve 304 such that water flows from an outlet of the solenoid valve 302' to an inlet of the mixing valve 304. The solenoid valve 302' receives water from a water supply, shown as hot supply 308 and cold supply 310. In various embodiments, the water supply may be a hot supply 308, a cold supply 310, both the hot supply 308 and the cold supply 310, may include other supplies (e.g., filtered water, extra-hot water, a beverage, etc.), or any combination thereof. According to various embodiments, the solenoid valve 302' may include a single solenoid actuating both the hot valve and the cold valve, may include a hot solenoid and valve and a cold solenoid and valve in one housing, or may include a hot solenoid and valve in a first housing and a cold solenoid and valve in a second housing. In an embodiment with separate hot and cold solenoids, the processing electronics 232 may be configured to only actuate the hot solenoid (e.g., for washing dishes) or only actuate the cold solenoid (e.g., for drinking water) in response to different hand motions in the detection zone 240 or in response to contact (e.g., touch, touch gestures, etc.) with the sensor assembly 200.

Since the water runs through solenoid valve 302, 302', the flow of water through faucet assembly 300, 300' may be controlled by a sensor (e.g., sensor assembly 200). Sensor assembly 200 may be configured to transmit a signal (e.g., voltage, current, instructions, etc.) to solenoid valve 302, 302' that causes the solenoid valve 302, 302' to open or close, allowing or disallowing the flow of water in faucet assembly 300, 300'. Further, sensor assembly 200 may be configured to transmit a signal to solenoid valve 302, 302' relating to the temperature of the water or to the rate of discharge of water in faucet assembly 300, 300'.

Figure 14:
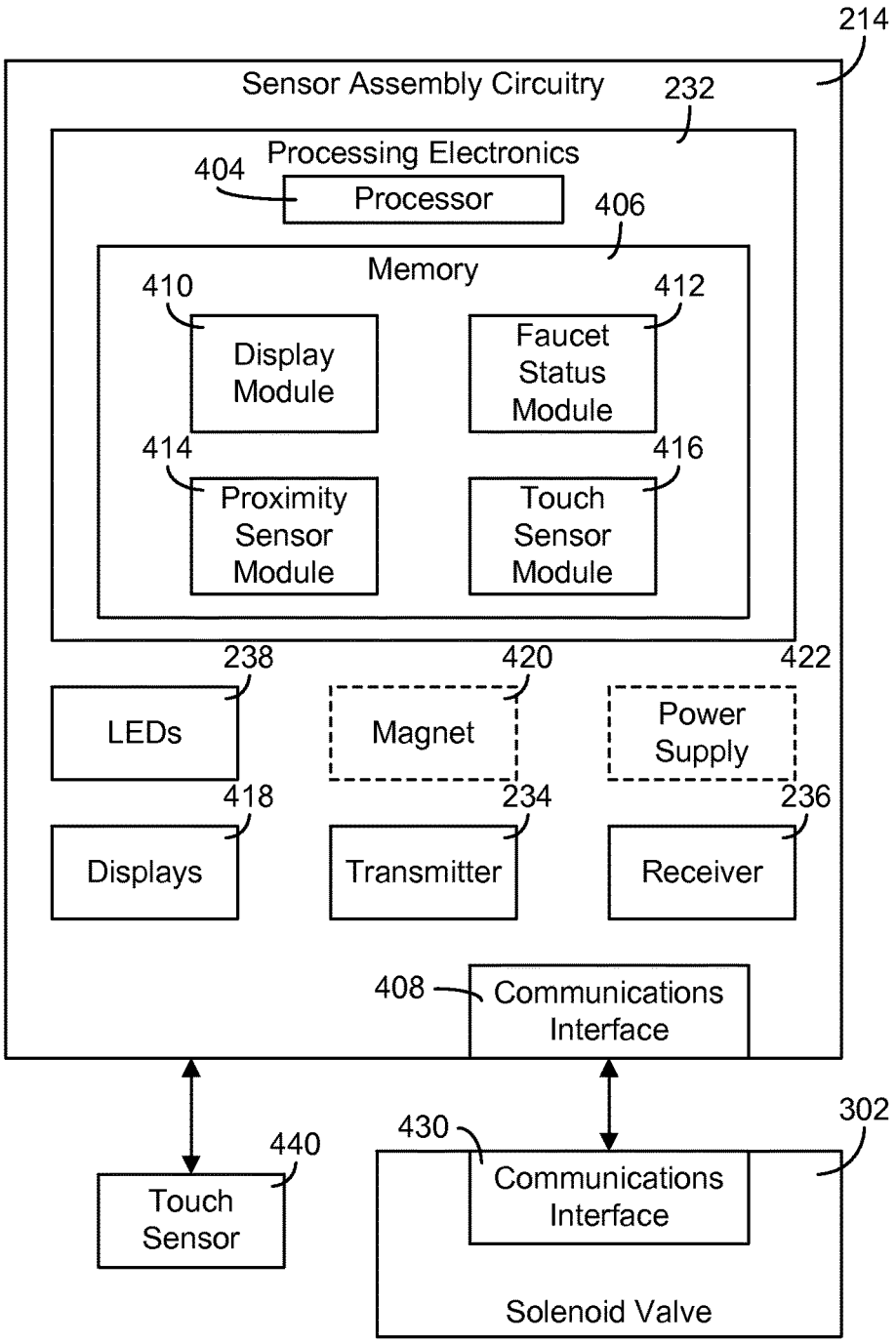
FIG. 14 is a detailed block diagram of the processing electronics of the sensor, according to an exemplary embodiment.

Referring now to FIG. 14, a detailed block diagram of sensor assembly circuitry 214 for sensor assembly 200 is shown, according to an exemplary embodiment. Circuitry 214 is generally shown to include processing electronics 232 housed within head 202 of sensor assembly 200 as shown in previous figures. Circuitry 214 further includes one or more LEDs 238 or other displays 418, and optionally a magnet 420 and power supply 422. It should be understood that while the various components shown in FIG. 14 are shown as part of processing electronics 232 or more generally circuitry 214, in other embodiments, various components may be located remotely from circuitry 214.

Processing electronics 232 are shown to include a processor 404 and memory 406. Processor 404 may be or include one or more microprocessors, an application specific integrated circuit (ASIC), a circuit containing one or more processing components, a group of distributed processing components, circuitry for supporting a microprocessor, or other hardware configured for processing. According to an exemplary embodiment, processor 404 is configured to execute computer code stored in memory 406 to complete and facilitate the activities described herein. Memory 406 can be any volatile or non-volatile memory device capable of storing data or computer code relating to the activities described herein. For example, memory 406 is shown to include modules 410-416 which are computer code modules (e.g., executable code, object code, source code, script code, machine code, etc.) configured for execution by processor 404. When executed by processor 404, processing electronics 232 is configured to complete the activities described herein. Processing electronics 232 includes hardware circuitry for supporting the execution of the computer code of modules 410-416.

Memory 406 is shown to include a display module 410. Display module 410 is configured to control one or more displays of sensor assembly 200. For example, display module 410 may control LEDs 238 and display 418. Display module 410 may be configured to illuminate one or more LEDs 238 based on a current status of the faucet system or user interaction with sensor assembly. For example, LEDs 238 may be illuminated by display module 410 to indicate that the solenoid valve (and faucet) is open or closed. As another example, LEDs 238 may be arranged on sensor assembly 200 in a ring, line, or other pattern. LEDs 238 may be illuminated sequentially (e.g., the lights "chase" in a circle, the lights "chase down the line, etc.) by display module 410 when the solenoid valve is open and water is running through the faucet, or may be illuminated in a steady state when water is not running through the faucet. As another example, display module 410 may illuminate one or more LEDs 238 to indicate a pause in the flow of water related to a user input. Yet other patterns of LED illumination (e.g., the number of LEDs illuminated, different colors of illuminated LEDs, different patterns of illuminated lights) may be possible to indicate a current status of the solenoid valve (e.g., green or blue LEDs correspond with an open solenoid valve, red LEDs with a closed solenoid valve, etc.), to indicate a temperature or rate of flow of the water (e.g., red, white, and blue may indicate the flow of hot, warm, and cold water, respectively; the pattern of LEDs may sequentially indicate temperature from cold to hot; the pattern of LEDs may indicate temperature of the water in binary, etc.), or otherwise (e.g., a pattern of LEDs may indicate a fault code, for example, low battery, insufficient grounding, etc.). In addition or alternatively to LEDs 238, display module 410 may control other displays 418 (e.g., other light sources, a liquid crystal display (LCD), a display coupled to sensor assembly 200, etc.).

In one embodiment, display module 410 may further be configured to control a display on cover 212. For example, cover 212 may include one or more symbols or text coupled to, or etched, printed, or formed on cover 212 that may be illuminated to display a faucet system status to the user. For example, the display may prompt a user to wave his or her hand over sensor assembly 200 (e.g., via a symbol of a waving hand or text that says "wave hand"), to touch sensor assembly 200, or to otherwise interact with sensor assembly 200. Display module 410 may be configured to control the display on cover 212 in a similar manner to LEDs 238.

In one embodiment, the display (either on cover 212 or display 418 on sensor assembly 200) may cue the user how to interact with sensor assembly 200. For example, the display may indicate to the user how to activate the faucet (e.g., a hand wave associated with turning on the faucet), how to pause or stop the flow of water, text that says "wave on," "wave off," "wave hand," or "press cover," etc.).

Sensor assembly circuitry 214 is shown to include a transmitter circuit 234 and receiver circuit 236. While transmitter circuit 234 and receiver circuit 236 are shown and described as separate in FIG. 14, in another embodiment, both circuits 234, 236 may be a single transmitter/receiver (T/R) circuit. Transmitter circuit 234 is configured to project a beam through cover 212 of sensor assembly 200. The transmitter may be an infrared transmitter. The beam may be projected into a detection zone of sensor assembly 200 in which a user may interact with sensor assembly 200 to turn on or off the faucet. Receiver circuit 236 is configured to detect a reflection of the beam off an object in the detection zone (e.g., to detect a user's hand, a sponge, a dish, etc. in the detection zone). In one embodiment, receiver circuit 236 is configured to detect an object within approximately 30 centimeters or twelve inches from sensor assembly 200, within approximately 20 centimeters or eight inches from sensor assembly 200, or from another distance. A limited range of detection may prevent accidental activation of the faucet and may prevent reflections from the ceiling, wall, or other stationary object. The detection zone area may be adjusted based on such considerations. A proximity sensor module 414 may be configured to receive an indication of the reflection of the beam and to interpret the indication as a user command or request.

Proximity sensor module 414 is configured to receive the indication of a detection by receiver circuit 236 and to interpret the indication. For example, proximity sensor module 414 may determine a type of user interaction (e.g., if the user waved his or her hand in front of the sensor, if the user's hand performed another type of motion, etc.). Proximity sensor module 414 may then determine a corresponding action with solenoid valve 302 (e.g., to open or close the valve, to leave the valve open for a predetermined time). For example, proximity sensor module 414 may determine that the user waved his or her hand, and may change the state of solenoid valve 302 in response (e.g., to switch from open to closed or closed to open). The user may wave his or her hand a first time to cause proximity sensor module 414 to determine that the solenoid valve should open, and a second time to cause proximity sensor module to determine that the solenoid valve should close. As another example, proximity sensor module 414 may determine that a wave of the user's hand corresponds with leaving solenoid valve 302 open for a predetermined amount of time. As yet another example, the user may hold an object over the sensor for a predetermined period of time (e.g., 1 second, 2 seconds, 3 seconds, etc.) to open solenoid valve 302 for a second predetermined period of time (e.g., 20 seconds, 30 seconds, 1 minute, etc.). It should be understood that any combination of hand gestures and solenoid valve actuation may be possible.

In one embodiment, proximity sensor module 414 may be configured to determine where in the detection zone the user interacted with sensor assembly 200. For example, proximity sensor module 414 may interpret a hand wave three inches from the sensor differently from a hand wave eleven inches from the sensor. Sensor assembly 200 may then use the object location within the detection zone to change the solenoid valve status, to change the amount of time to leave the solenoid valve open, or otherwise. For example, a hand wave closer to sensor assembly 200 may relate to a command to fill the sink with water halfway, and a hand wave farther away from sensor assembly 200 may relate to a command to fill the sink to the top with water. As another example, raising or moving away an object over the sensor may cause a first response (e.g., to open the solenoid valve long enough to substantially fill a pot) and lowering an object over the sensor may cause a second response (e.g., to open the solenoid valve in order to substantially fill the basin with water).

Sensor assembly circuitry 214 may include a touch sensor 440 as generally described in FIGS. 3-9. Touch sensor 440 may detect a user interaction with cover 212 and may be connected to sensor assembly 200. Memory 406 is shown to include a touch sensor module 416 configured to receive an input from touch sensor 440 and to interpret user interaction with cover 212. For example, touch sensor module 416 may receive an indication that the user tapped on cover 212 and may change the state of solenoid valve 302 in response (e.g., to switch from open to closed or closed to open). As another example, touch sensor module 416 may receive an indication that the user pressed down on cover 212 for an amount of time and may change the state of the solenoid valve as a result. As yet another example, solenoid valve 302 may open for as long as cover 212 is touched, and may close once the user stops touching cover 212.

It should be understood that any combination of hand gestures, touching of the cover, and solenoid valve actuation may be possible. For example, one hand gesture or touch of the cover may correspond with a command to fill the sink with water. One of modules 414, 416 may interpret the interaction and indicate to faucet status module 412 to provide an indication to solenoid valve 302 to fill the sink with water. As another example, one hand gesture or touch of the cover may correspond with a command to turn the faucet on for a predetermined amount of time (e.g., 5 seconds, 10 seconds, 20 seconds, 30 seconds, etc.). Other commands relating to the filling of the sink with water, the draining of water, the amount of water to dispense, the temperature of the water, or otherwise may be possible.

Memory 406 is shown to include a faucet status module 412. Faucet status module 412 may be configured to receive an input from modules 414, 416 relating to a desired solenoid valve 302 state relating to a user interaction with sensor assembly 200. Faucet status module 412 may then provide an indication to solenoid valve 302 via communications interface 408. Faucet status module 412 may further be configured to receive a solenoid valve status from solenoid valve 302. Faucet status module 412 may then provide the status to display module 410. Display module 410 may be configured to generate a display (via display 418 or indicia on cover 212) indicating the solenoid valve status. Faucet status module 412 may further receive an input from solenoid valve 302 relating to a status of the sink (e.g., if the sink is full with water, the rate at which the sink is filling with water, etc.). Faucet status module 412 may then provide the status to display module 410 for display as well.

Sensor assembly circuitry 214 includes a communications interface 408 configured to be in communication with a communications interface 430 of solenoid valve 302. Interfaces 408, 430 may be configured to establish wireless communications between sensor assembly 200 and solenoid valve 302. In one embodiment, interfaces 408, 430 may communicate via Bluetooth or via another wireless protocol. Alternatively, interfaces 408, 430 may be wired interfaces configured to communicate with one another via a wired connection.

Sensor assembly circuitry 214 may optionally include a magnet 420 for coupling sensor assembly to a metallic surface. Magnet 420 may be located on, for example, head 202 or more particularly bottom portion 206. Sensor assembly circuitry 214 may optionally include a power supply 422, such as a battery electrically coupled to processing electronics 232. Alternatively, sensor assembly circuitry 214 may be connected to a remote power supply (e.g., mains power).

Figure 15:
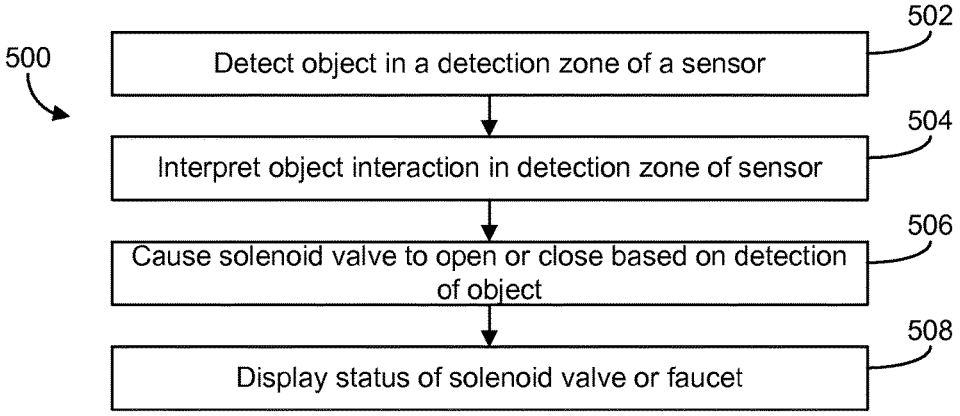
FIG. 15 is a flow chart of a process for controlling the flow of water through a faucet via the sensor and sensor assembly of the present disclosure, according to an exemplary embodiment.

Referring now to FIG. 15, a flow chart of a process 500 for controlling the flow of water through a faucet via the sensor and sensor assembly of the present disclosure is shown, according to an exemplary embodiment. Process 500 may be executed by, for example, the processing electronics of sensor assembly 200 as described above. Process 500 may be executed in order to control the status of a solenoid valve of a faucet system as described in the present disclosure.

Process 500 includes detecting an object in a detection zone of the sensor (step 502). Step 502 may generally include a transmitter of the proximity sensor of the sensor assembly projecting a beam into the detection zone, and detecting a reflection of the beam by a receiver of the of the proximity sensor. The object may be, for example, a user's hand. Process 500 further includes interpreting the object interaction in the detection zone of the sensor (step 504). For example, step 504 may include determining that the user waved his or her hand, and that such a wave corresponds with a command to open the solenoid valve in order to trigger the flow of water through the faucet. Step 504 may include any number of gesture interpretation steps or otherwise for identifying the type of object interaction, and associating the user interaction with one or more faucet system operation commands.

Process 500 further includes causing the solenoid valve to open or close based on the detection of the object (step 506). For example, step 506 may include switching the solenoid valve from a closed state to open (or vice versa). Step 506 may be executed by the sensor assembly by wirelessly connecting with a communications interface of the solenoid valve and transmitting the instructions to the solenoid valve. Step 506 may further include receiving information back from the communications interface of the solenoid valve (e.g., a status of the solenoid valve). Process 500 further includes displaying the status of the solenoid valve or faucet (step 508). For example, the sensor assembly may include one or both of LEDs or indicia on the cover of the sensor assembly that may be used to display a status to the user. For example, one or more LEDs may illuminate to indicate that the solenoid valve is currently open and water is flowing into the sink.

Process 500 may be repeated for subsequent object detections. For example, a second reflection of an object may be detected, and process 500 may repeat for the second reflection. If the first reflection related to a command to open the solenoid valve, the second reflection may indicate a command to close the solenoid valve. Process 500 may then include interpreting the interaction (step 504), closing the solenoid valve (step 506), and displaying the solenoid valve status via the LEDs or cover display (step 508).

Figure 16:
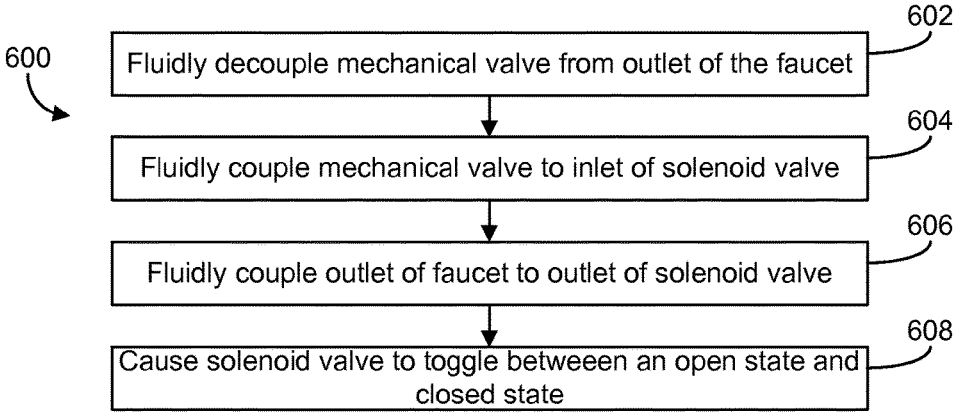
FIG. 16 is a flow chart of a process for retrofitting the sensor assembly and solenoid valve of the present disclosure to an existing faucet system, according to an exemplary embodiment.

Referring to FIG. 16, a flow chart of a process 600 for retrofitting the sensor assembly and solenoid valve of the present disclosure to an existing faucet system is shown, according to an exemplary embodiment. Process 600 includes fluidly decoupling the mechanical valve from the outlet of the faucet (step 602). In traditional faucet systems, the mechanical valve is fluidly coupled to the faucet outlet and is configured to provide a mixed supply (e.g., mix of hot and cold water) to the faucet outlet.

Process 600 further includes fluidly coupling the mechanical valve to the inlet of a solenoid valve (step 604) and fluidly coupling the outlet of the faucet to the outlet of the solenoid valve (step 606). As a result, the mixed supply of water may run from the mechanical valve to the faucet outlet through the solenoid valve. Process 600 further includes causing the solenoid valve to toggle between an open state and closed state (step 608). In other words, step 608 includes permitting the flow of water through the faucet outlet only when the solenoid valve is open. The solenoid valve state may be controlled via the sensor assembly, and more particularly by an object interacting with the sensor assembly, as described in the present disclosure.

Figure 17:
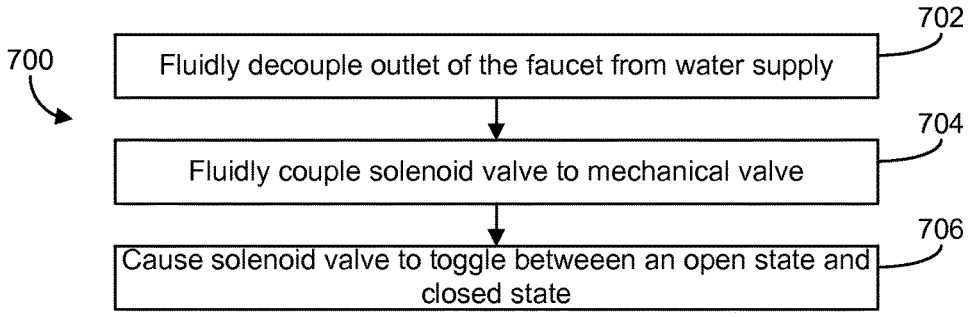
FIG. 17 is a flow chart of a process for retrofitting the sensor assembly and solenoid valve of the present disclosure to an existing faucet system, according to another exemplary embodiment.

Referring to FIG. 17, a flow chart of a process 700 for retrofitting the sensor assembly and solenoid valve assembly of the present disclosure to an existing faucet system is shown, according to another exemplary embodiment. Process 700 includes fluidly decoupling the outlet of the faucet from the water supply (step 702). According to various embodiments, the decoupling of the outlet of the faucet from the water supply may occur upstream of the mechanical valve, downstream of the mechanical valve, or any combination thereof. Process 700 further includes fluidly coupling a solenoid valve to the mechanical valve (step 704) and causing the solenoid valve to toggle between an open state and closed state (step 706).

Figure 18:
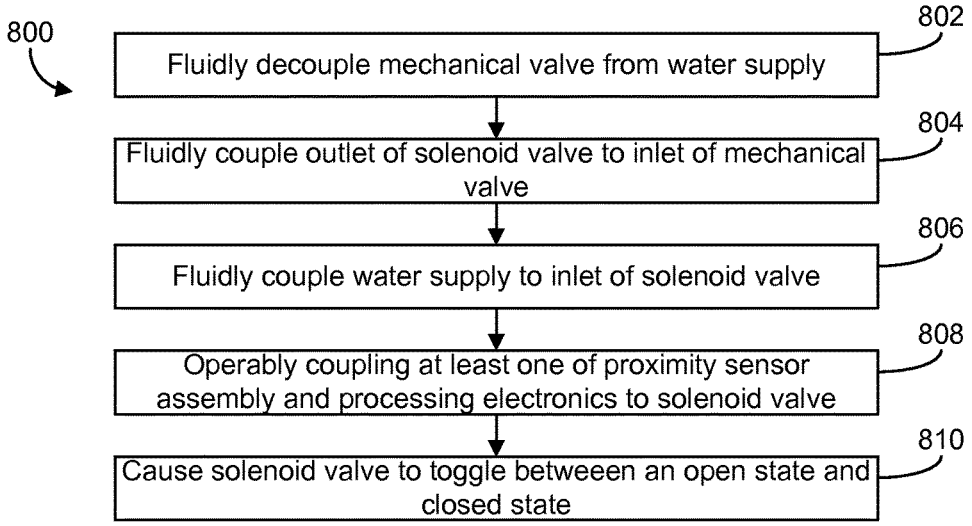
FIG. 18 is a flow chart of a process for retrofitting the sensor assembly and solenoid valve of the present disclosure to an existing faucet system, according to another exemplary embodiment.

Referring to FIG. 18, a flow chart of a process 800 for retrofitting the sensor assembly and solenoid valve assembly of the present disclosure to an existing faucet system is shown, according to another exemplary embodiment. Process 800 includes fluidly decoupling the mechanical valve from the water supply (step 802). Process 800 further includes fluidly coupling an outlet of the solenoid valve to an inlet of the mechanical valve (step 804). According to one embodiment, step 804 may include coupling a first or hot outlet of the solenoid valve to a first or hot inlet of the mechanical valve and coupling a second or cold outlet of the solenoid valve to a second or cold inlet of the mechanical valve. Process 800 further includes fluidly coupling a water supply to an inlet of the solenoid valve (step 806). According to one embodiment, step 806 may include coupling a first or hot water supply to a first or hot inlet of the solenoid valve and coupling a second or cold water supply to a second or cold inlet of the solenoid valve. Process 800 further includes operably coupling at least one of a proximity sensor assembly and processing electronics to the solenoid valve (step 808) and causing the solenoid valve to toggle between an open state and closed state (step 810).

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A sensor assembly for controlling a solenoid valve, the solenoid valve controlling a flow of water through a faucet, the faucet being spaced apart from the sensor assembly, the sensor assembly comprising:

a shank passing through an aperture in a wall and terminating at a flange at a first end of the shank;

a head coupled to the shank, the head comprising:

a base having a first side configured to be supported by a first side of the wall and a second side configured to interface with a first side of the flange, the base comprising an opening and a hole configured to receive an at least partially-threaded portion of the shank, wherein the flange is entirely contained within the base;

a top portion opposite the base and comprising a transparent or translucent cover that covers the opening of the base; and circuitry positioned between the transparent or translucent cover and a second side of the flange opposite the first side, the circuitry at least partially received within a recess in the shank and interfacing with the second side of the flange, the circuitry comprising:

a proximity sensor comprising:

a transmitter configured to project a beam into a detection zone on the first side of the wall through the transparent or translucent cover, the beam extending substantially normal to and away from the wall; and a receiver configured to detect a reflection of the beam off of an object in the detection zone; and processing electronics configured to cause the solenoid valve to open in response to the receiver detecting a first reflection from the object in the detection zone; and a nut threadedly coupled to the shank and configured to be supported by a second side of the wall opposite the first side of the wall such that tightening the nut on the shank secures the head on the first side of the wall and secures the nut on the second side of the wall.

2. The sensor assembly of claim 1, wherein the wall comprises a rim extending from a basin, the rim defining the aperture and defining at least one faucet hole for mounting the faucet to the rim, the aperture spaced apart from the at least one faucet hole.

3. The sensor assembly of claim 1, wherein the transmitter comprises an infrared transmitter, and the beam is projected through the transparent or translucent cover into the detection zone.

4. The sensor assembly of claim 3, further comprising an indicia located on the transparent or translucent cover, the indicia indicating to the user where to pass the object in order to actuate the faucet.

5. The sensor assembly of claim 1, wherein the head comprises at least one light emitting diode (LED), and wherein the processing electronics control illumination of the at least one LED to annunciate a state of the solenoid valve.

6. The sensor assembly of claim 5, wherein the at least one LED comprises a plurality of light emitting diodes arranged in a sequence, and wherein the processing electronics cause the at least one LED to illuminate sequentially when the solenoid valve is open.

7. The sensor assembly of claim 1, wherein the head comprises a touch sensor, and wherein the processing electronics cause the solenoid valve to open for a predetermined amount of time in response to the head being touched.

8. The sensor assembly of claim 1, wherein the faucet comprises a spout and at least one mechanical valve, each of the at least one mechanical valve having a handle operably coupled to the at least one mechanical valve, and wherein the solenoid valve is located upstream of the at least one mechanical valve.

9. The sensor assembly of claim 1, wherein the processing electronics are configured to cause the solenoid valve to close in response to the receiver detecting a second reflection from the object in the detection zone.

10. The sensor assembly of claim 1, further comprising:

a magnet disposed in the head and configured to magnetically couple the head to the wall; and a battery electrically coupled to the processing electronics;

wherein the processing electronics are configured to control the solenoid valve via wireless communication.

11. A system for controlling a flow of water through a faucet that provides water to a sink, the sink having a basin and a rim, the rim defining at least one faucet hole for mounting the faucet to the rim and defining an accessory hole spaced apart from the at least one faucet hole, the faucet having an outlet for discharging water into the basin and having at least one mechanical valve for controlling a temperature and a volume of the flow of water when the water is flowing, the system comprising:

a solenoid valve fluidly interconnected between the at least one mechanical valve and the outlet;

a shank passing through the accessory hole, the shank terminating on one end in a flange located on a first side of the rim, the flange having a first side and a second side, the first side configured to interface with a base of a head, the base comprising a hole and the base configured to be supported by the first side of the rim, wherein the flange is entirely contained within the base;

a proximity sensor positioned on circuitry that interfaces with the second side of the flange and configured to detect an object in a detection zone above the base; and a nut threadedly coupled to the shank and configured to be supported by a second side of the rim opposite the first side of the rim such that tightening the nut on the shank secures the base on the first side of the rim and secures the nut on the second side of the rim;

wherein the solenoid valve is configured to close in response to a first detection by the proximity sensor of an object in the detection zone.

12. The system of claim 11, wherein the base comprises at least one of a vacuum breaker and a soap dispenser.

13. The system of claim 11, wherein the proximity sensor comprises an infrared transmitter, and the proximity sensor is configured to detect an object within approximately 30 centimeters of the infrared transmitter.

14. The system of claim 11, further comprising an indicia proximate the proximity sensor cueing the user where to pass an object in order to actuate the faucet;

wherein the indicia is illuminated when the solenoid valve is closed.

15. A kit for retrofitting an existing faucet system from manual to touchless operation, the existing faucet system including a faucet having an outlet for discharging water from the faucet into a basin and having a mechanical valve fluidly coupled to the outlet for controlling a flow of water through the faucet, the mechanical valve configured to receive water from a water supply, the kit comprising:

a solenoid valve assembly having at least one solenoid valve, an inlet, and an outlet;

a proximity sensor assembly configured to detect an object in a detection zone comprising:

circuitry comprising a transmitter configured to project a beam into the detection zone on a first side of a wall, the beam extending substantially normal to and away from the wall;

a head having a base having a first side configured to be supported by the first side of the wall and the base having a second side configured to interface with a first side of a flange of a shank, the base comprising a hole configured to receive a portion of the shank, wherein the shank terminates on one end at the flange, wherein the flange is entirely contained within the base, and wherein a second side of the flange interfaces with the circuitry within the base; and a nut threadedly coupled to the shank and configured to be supported by a second side of the wall opposite the first side of the wall such that tightening the nut on the shank secures the head on the first side of the wall and secures the nut on the second side of the wall;

processing electronics configured to toggle the at least one solenoid valve between an open state and a closed state in response to the proximity sensor assembly detecting the object in the detection zone; and instructions for retrofitting the existing faucet system, the instructions comprising:

fluidly decoupling the outlet of the faucet from the water supply;

fluidly coupling the solenoid valve assembly to the mechanical valve;

placing the object in the detection zone to cause the at least one solenoid valve to toggle between the open state and the closed state.

16. The kit of claim 15, wherein:

the basin has a rim coupled to a countertop;

at least one of the basin and the countertop define at least one faucet hole for mounting the faucet;

at least one of the basin and the countertop define an accessory hole spaced apart from the at least one faucet hole; and the instructions further comprise inserting the shank into the accessory hole.

17. The kit of claim 15, wherein the transmitter comprises a wireless communication transmitter, and the solenoid valve assembly comprises a wireless communication receiver, and wherein the instructions further comprise establishing wireless communication between the proximity sensor assembly and the solenoid valve assembly.

18. The kit of claim 15, wherein the instructions for retrofitting the existing faucet system specify that fluidly decoupling the outlet of the faucet from the water supply comprises fluidly decoupling the mechanical valve from the water supply;

wherein the instructions for retrofitting the existing faucet system specify that fluidly coupling the solenoid valve assembly to the mechanical valve comprises fluidly coupling the outlet of the solenoid valve assembly to an inlet of the mechanical valve; and wherein the instructions further comprise:

fluidly coupling the water supply to the inlet of the solenoid valve assembly; and operably coupling at least one of the proximity sensor assembly and the processing electronics to the solenoid valve assembly.

19. The kit of claim 18, wherein:

the inlet of the mechanical valve comprises a first hot inlet and a first cold inlet;

the outlet of the solenoid valve assembly comprises a hot outlet and a cold outlet;

the inlet of the solenoid valve assembly comprises a second hot inlet and a second cold inlet;

the water supply comprises a hot supply and a cold supply;

fluidly coupling the inlet of the mechanical valve to the outlet of the solenoid valve assembly comprises fluidly coupling the first hot inlet to the hot outlet and fluidly coupling the first cold inlet to the cold outlet; and fluidly coupling the water supply to the inlet of the solenoid valve assembly comprises fluidly coupling the hot supply to the second hot inlet and fluidly coupling the cold supply to the second cold inlet.

* * * * *